US005261467A

United States Patent [19]

Yamamoto et al.

[11] Patent Number: 5,261,467

[45] Date of Patent: Nov. 16, 1993

[54] CUP TYPE AUTOMATIC VENDING MACHINE

[75] Inventors: Hiroshi Yamamoto; Yoshiyuki Kato, both of Saitama; Naoto Fukushima, Gunma; Nobutoshi Migishima, Saitama; Takashi Uzawa, Saitama; Hajime Erikawa, Saitama; Yasuhiko Miyata, Saitama, all of Japan

[73] Assignee: Sanyo Electric Co., Ltd., Osaka, Japan

[21] Appl. No.: 717,210

[22] Filed: Jun. 18, 1991

[30] Foreign Application Priority Data

| | | | |
|---|---|---|---|
| Jun. 20, 1990 | [JP] | Japan | 2-159937 |
| Jun. 20, 1990 | [JP] | Japan | 2-159940 |
| Jun. 29, 1990 | [JP] | Japan | 2-169925 |
| Jun. 29, 1990 | [JP] | Japan | 2-169927 |
| Jul. 3, 1990 | [JP] | Japan | 2174411 |
| Jul. 6, 1990 | [JP] | Japan | 2-177556 |
| Jul. 10, 1990 | [JP] | Japan | 2-180438 |
| Jul. 10, 1990 | [JP] | Japan | 2-180439 |

[51] Int. Cl.[5] ..... B65B 3/04

[52] U.S. Cl. ..... 141/174; 141/97; 141/129; 221/5; 222/129.1

[58] Field of Search ..... 141/174, 97, 175, 176, 141/153, 168, 129; 221/5; 222/129.1-129.4

[56] References Cited

U.S. PATENT DOCUMENTS

| | | | |
|---|---|---|---|
| 2,811,993 | 11/1957 | Ferdon | 141/174 X |
| 2,852,043 | 9/1958 | Cooper | 141/174 X |
| 3,000,408 | 9/1961 | Vischer, Jr. | 141/174 |
| 3,336,957 | 8/1967 | Goosman | 141/174 X |
| 4,009,740 | 3/1977 | Michielli | 141/174 X |
| 4,747,516 | 5/1988 | Baker | 222/129.1 |
| 4,967,808 | 11/1990 | Credle, Jr. et al. | 141/9 |
| 5,000,345 | 3/1991 | Brogna et al. | 221/5 |
| 5,141,130 | 8/1992 | Wiley et al. | 222/1 |

*Primary Examiner*—Ernest G. Cusick
*Attorney, Agent, or Firm*—Darby & Darby

[57] ABSTRACT

Cups stored in the automatic vending machine are released and dropped from a cup supply unit to a cup holding unit one at a time and drink is injected thereinto as selected by a customer. The cup holding unit holding the cup filled with drink is transported approximately horizontally by a front/back cup transport unit to a vertical cup transport unit. As the vertical cup transport unit lifts the cup upward, the vending door is opened to expose to the customer the upper portion of the cup out of the cup outlet, as if the cup were sitting on a counter table in the front of the vending machine.

23 Claims, 42 Drawing Sheets

FIG. 23

| OPERATING MODE | CUP HOLDING UNIT | HORIZONTAL CUP TRANSPORT UNIT | VERTICAL CUP TRANSPORT UNIT | VENDING DOOR |
|---|---|---|---|---|
| (1)STANDBY | STANDBY | STANDBY | STANDBY | CLOSED |
| (2)VENDING SIGNAL | STANDBY | STANDBY | LOW | CLOSED |
| (3)CUP DROPPED | GRABBED | STANDBY | LOW | CLOSED |
| (4)DRINK VENDING | GRABBED | STANDBY | LOW | CLOSED |
| (5)TRANSPORT | GRABBED | INTERMEDIATE | LOW | OPEN |
| (6)TRANSPORT | GRABBED | FRONT | LOW | OPEN |
| (7)CUP TRANSFERRED | GRABBED | FRONT | INTERMEDIATE | OPEN |
| (8)CUP TRANSFERRED | OPEN | FRONT | INTERMEDIATE | OPEN |
| (9)VENDING | OPEN | FRONT | VENDING | OPEN |
| (10)NEXT VENDING | OPEN<br>STANDBY | INTERMEDIATE<br>STANDBY | VENDING<br>VENDING | OPEN<br>OPEN |
| (11) STANDBY | STANDBY | STANDBY | STANDBY | CLOSED |

FIG. 41

| | | -2 | -1 | 0 | +1 | +2 | | |
|---|---|---|---|---|---|---|---|---|
| (1) | SUGAR (DECREASE) | ○ | ○ | ○ | ○ | ○ | (INCREASE) ○ | NO SUGAR/NO CREAM |
| | CREAM (DECREASE) | ○ | ○ | ○ | ○ | ○ | (INCREASE) | |
| | COFFEE (DECREASE) | ○ | ○ | ○ | ○ | ○ | (INCREASE) ○ | NO ICE/ICE PRESENT |
| (2) | SUGAR (DECREASE) | ○ | ○ | ● | ○ | ○ | (INCREASE) ○ | NO SUGAR/NO CREAM |
| | CREAM (DECREASE) | ○ | ○ | ● | ○ | ○ | (INCREASE) | |
| | COFFEE (DECREASE) | ○ | ○ | ● | ○ | ○ | (INCREASE) ○ | NO ICE/ICE PRESENT |
| (3) | SUGAR (DECREASE) | ○ | ● | ○ | ○ | ○ | (INCREASE) ○ | NO SUGAR/NO CREAM |
| | CREAM (DECREASE) | ○ | ○ | ● | ○ | ○ | (INCREASE) | |
| | COFFEE (DECREASE) | ○ | ○ | ● | ○ | ○ | (INCREASE) ○ | NO ICE/ICE PRESENT |
| (4) | SUGAR (DECREASE) | ● | ○ | ○ | ○ | ○ | (INCREASE) ○ | NO SUGAR/NO CREAM |
| | CREAM (DECREASE) | ○ | ○ | ● | ○ | ○ | (INCREASE) | |
| | COFFEE (DECREASE) | ○ | ○ | ● | ○ | ○ | (INCREASE) ○ | NO ICE/ICE PRESENT |
| (5) | SUGAR (DECREASE) | ○ | ● | ○ | ○ | ○ | (INCREASE) ○ | NO SUGAR/NO CREAM |
| | CREAM (DECREASE) | ○ | ○ | ● | ○ | ○ | (INCREASE) | |
| | COFFEE (DECREASE) | ○ | ○ | ● | ○ | ○ | (INCREASE) ○ | NO ICE/ICE PRESENT |
| (6) | SUGAR (DECREASE) | ○ | ○ | ● | ○ | ○ | (INCREASE) ○ | NO SUGAR/NO CREAM |
| | CREAM (DECREASE) | ○ | ○ | ● | ○ | ○ | (INCREASE) | |
| | COFFEE (DECREASE) | ○ | ○ | ● | ○ | ○ | (INCREASE) ○ | NO ICE/ICE PRESENT |
| (7) | SUGAR (DECREASE) | ○ | ○ | ○ | ● | ○ | (INCREASE) ○ | NO SUGAR/NO CREAM |
| | CREAM (DECREASE) | ○ | ○ | ● | ○ | ○ | (INCREASE) | |
| | COFFEE (DECREASE) | ○ | ○ | ● | ○ | ○ | (INCREASE) ○ | NO ICE/ICE PRESENT |
| (8) | SUGAR (DECREASE) | ○ | ○ | ○ | ○ | ● | (INCREASE) ○ | NO SUGAR/NO CREAM |
| | CREAM (DECREASE) | ○ | ○ | ● | ○ | ○ | (INCREASE) | |
| | COFFEE (DECREASE) | ○ | ○ | ● | ○ | ○ | (INCREASE) ○ | NO ICE/ICE PRESENT |

CUP TYPE AUTOMATIC VENDING MACHINE

FIELD OF THE INVENTION

The present invention relates to a cup type automatic vending machine which supplies a cup from a cup supply unit at the start of a vending operation, and various types of beverages injected one at a time in the cup.

BACKGROUND OF THE INVENTION

In general, a cup type automatic vending machine of this type has tanks for beverages installed at an upper position within the machine, and a cup is placed at a lower position of the machine in order to receive a beverage. In a typical cup type automatic vending machine, as disclosed in the Japanese Provisional Utility Model Publication No. 16278/1985, a cup filled with drink is taken out by opening a transparent door of a vending corner, which is arranged at a low position of the machine. For this reason, the customer has to bend forward or crouch to take the cup, causing the customer great inconvenience and discomfort. Also, the consumer has to take up the cup by one hand while opening the door by the other hand. This is a troublesome procedure. The cup is held by elastic cup grabbers within the vending corner, so that it is not very easy to free the cup from the grabbers by one hand. For this reason, the drink is sometimes spilled from the cup when the cup is taken out. The spilt drink stains the cup grabbers, causing hygienic problems.

BRIEF SUMMARY OF THE INVENTION

To overcome the above problems pertinent to the prior art, the invention provides a cup type automatic vending machine which allows the customer to take out his cup easily from the vending corner without spilling, thereby leaving the recessed vending corner in perfectly hygienic conditions.

It is another object of the invention to provide a cup type automatic vending machine having a cup holding unit which can prevent dripping drink in a cup.

It is still another object of the invention to provide a cup type automatic vending machine which can detect malfunction of the cup supply unit, and provide adequate corrective measures immediately.

It is another object of the invention that a misplaced cup, e.g. one trapped above or tilted in the cup holding unit may be automatically corrected, thereby restoring normal position of the cup within the vending machine.

It is another object of the present invention to provide means for automatically eliminating a trouble caused by a cup trapped in a cup chute.

It is still another object of the invention to provide a consumer with drink as quickly as possible by decreasing his waiting time.

It is yet another object of this invention to analyze a nature of the trouble involved in the process of cup transportation, due to, for example power failure, and provide necessary resolution, e.g. disposition of the cup, in accordance with the analysis of the trouble to restore its normal operation.

It is another object of this invention to simplify procedures for the customer to remove his cup from a cup outlet.

It is yet another object of the invention to provide a new type of vending system having a vending corner covered with a vending door, which vending corner allows a drink filled cup to extend therefrom when the vending door is open, and which vending door can be operated safely and reliably.

It is still another object of the invention to simplify a procedure for a customer to take up his cup from the vending corner by lifting the drink filled cup to a high level by means of a vertical transport unit, and at the same time to provide a means for adjusting the timing of lifting said cup and the timing of opening the vending door in accordance with the conditions of the installation site of the vending machine.

It is still another object of the invention to provide a vending machine which may blend in multiple steps the drink materials in units of small quantity.

It is an object of the invention to provide an automatic vending machine capable of offering drink at a position higher than conventional one so that a customer may access the cup easier, and capable of serving the drink filled cup, without using grabbers and the like, on a counter table mounted on the front end of the vending machine so that a customer may easily take the cup without spilling drink, thereby maintaining the vending corner clean and not offending other customers.

It is yet another object of the invention to provide an automatic vending machine having means for returning the transport means to a condition ready for the next vending operation by automatically eliminating a cup left over in the transport means due to some abnormality (e.g. power failure) during the transportation of the cup.

It is still another object of the invention to provide a vending system which may move a drink filled cup upward to a high vending corner to allow for a customer to easily take up his cup, and which system may prevent dust resting on the automatic vending cover above the lifting route of the cup, from falling into the cup.

These and other objects and features of the invention will become obvious by the following description of the embodiments of the invention.

BRIEF DESCRIPTION OF THE DRAWINGS

FIG. 23 shows the operating conditions of the cup holding unit, front-rear cup transport unit, vertical cup transport unit, and vending door;

FIG. 41 shows the change in increase/decrease indicator lamps indication when the increase/decrease button is operated after a selection is made for coffee with sugar and milk;

DETAILED DESCRIPTION OF THE PREFERRED EMBODIMENT

Figure 1:
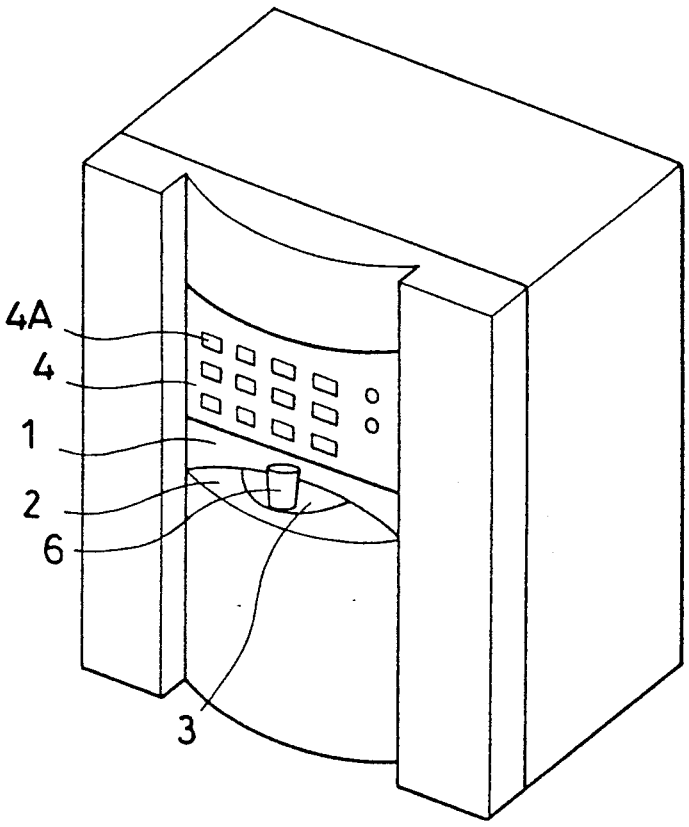
FIG. 1 is a general perspective view of a cup type automatic vending machine showing an embodiment of the invention.

FIG. 1 shows a general perspective view of a cup type automatic vending machine according to the present invention, where a vending corner 1 is designed, unlike conventional rectangular shaped vending corner, to provide a counter table 2 formed in a recess extending widely in lateral direction. The counter table 2 has a portion rising like a dome roof and has at its central portion a cup outlet 22 for furnishing a cup 6 to a customer. Below the dome shaped portion of the table is a rotatably mounted vending door 3, which has a hole to match the cup outlet. The cup outlet is normally closed by the vending door 3, but it is opened when the hole matches the cup outlet during vending operation. The vending corner 1 is installed at a higher level (e.g. by 900 mm) than in conventional vending machines. To be specific, it is formed immediately below a control panel 4 having selection buttons 4A. The vending corner 1 is recessed from the front end of the vending machine and has a wide lateral opening to furnish the cup 6 filled with drink to the customer.

The units for supplying cups, drinks, ice, etc. are installed at various positions within the machine.

Figure 2:
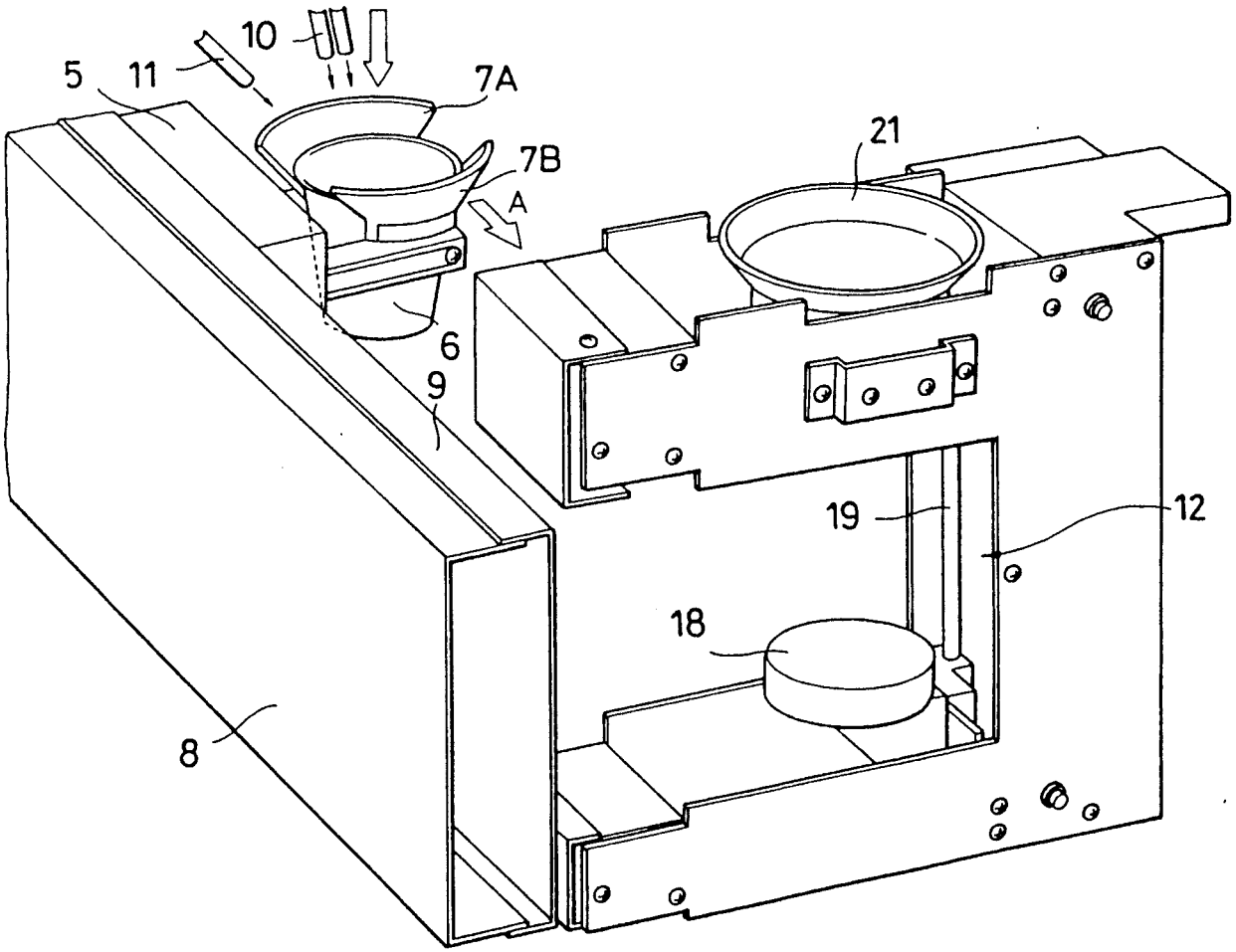
FIG. 2 is a perspective view of a vending mechanism, showing the process of injecting a drink in the cup and a process of moving the cup after injection.
Figure 3:
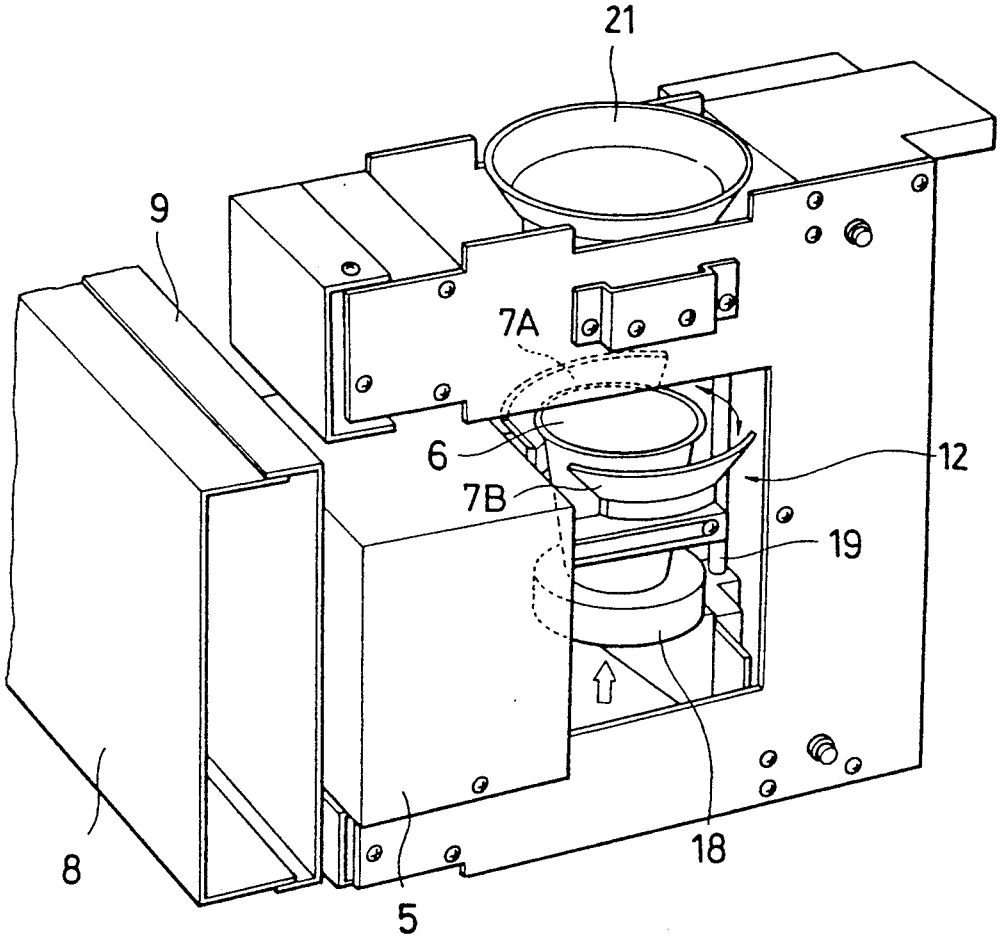
FIG. 3 is a perspective view of a vending mechanism, showing the condition thereof immediately after the cup is transferred to the vertical transport unit.
Figure 4:
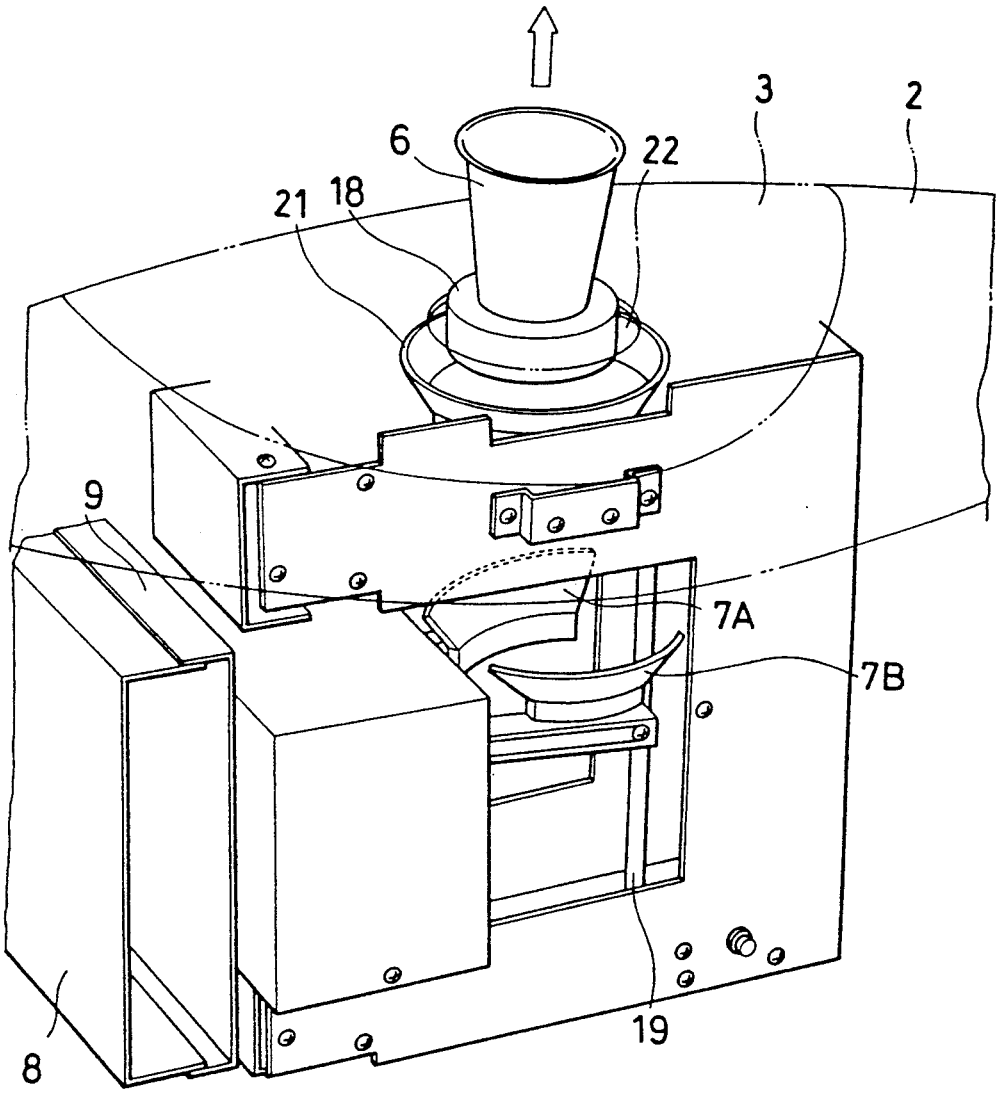
FIG. 4 is a perspective view of a vending mechanism, showing the condition thereof when the cup has moved from below the vending corner of the vending machine.

Referring now to FIGS. 2–4, arrangements of the major portions of the vending machine are described.

FIG. 2 shows how drink is injected in a cup and how the drink injected cup is moved to a vertical cup transport unit. FIG. 3 shows how the drink filled cup is moved upward by the vertical cup transport unit. FIG. 4 illustrates how the drink filled cup is moved up to the vending corner.

Figure 7:
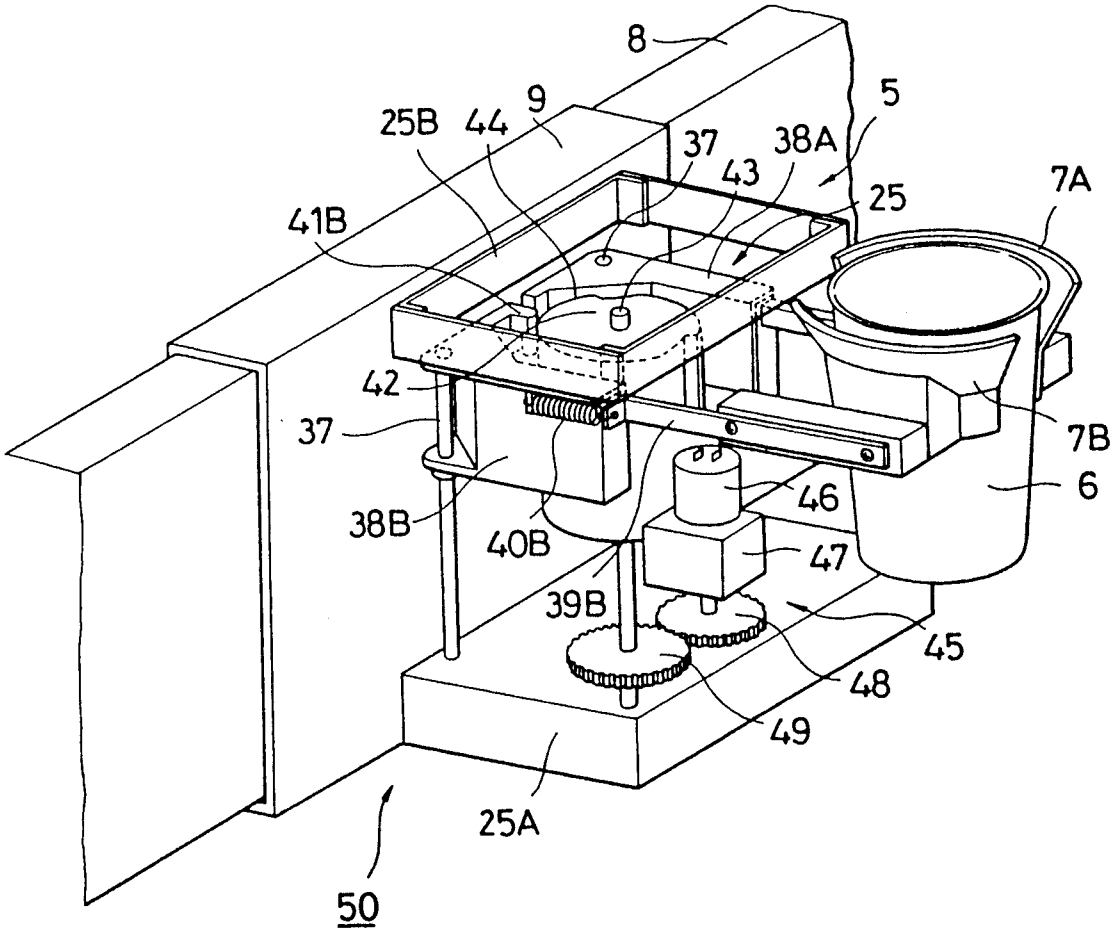
FIG. 7 is a perspective view of a cup holding unit.
Figure 8:
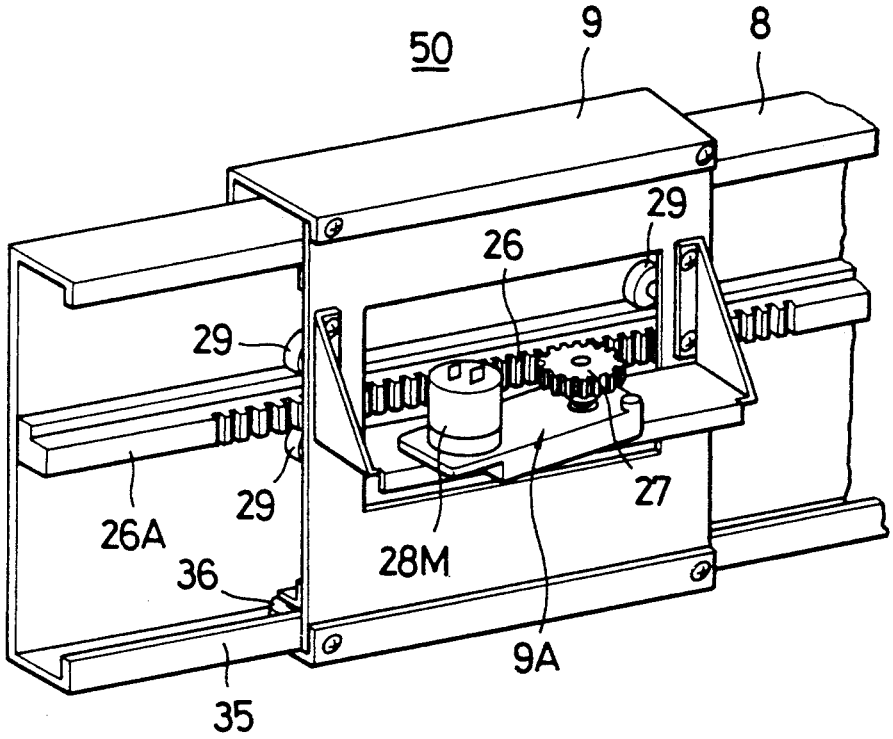
FIG. 8 is a perspective view of the cup holding unit seen from the rear side of the rail of a cup transport means.

In these figures, there is shown a cup holding unit 5 having an open-close type cup grabbers 7A and 7B for grabbing the cup 6 supplied, upon cup supply command, by the cup supplying unit. The cup grabber also serves as a cup transport unit. A slider unit 9 is slidably mounted on horizontal rails 8 installed in the cabinet of the automatic vending machine. The cup holding unit 5 can slide on the rails 8 towards or away from the front end of the automatic vending machine. A driving unit for sliding the cup holding unit 5 and a mechanism for opening or closing said cup grabbers 7A and 7B are shown in FIGS. 7 and 8. Details of the units will be given later. It is noted that a drink supplying unit and/or an ice making machine (not shown) are/is furnished above the cup holding unit 5, whose normal stand-by position is shown in FIG. 2. A drink injection nozzle 10 and an ice discharging hose 11 extend from these units to the cup 6. A drink supplying unit blends drink according to the selection made by the customer and, through the drink injection nozzle 10, injects the blended drink into the cup 6 held by the cup holding unit 5. The drink supplying unit may made carbonated drink by diluting syrup with carbonated water or other soft drink by, for example, dissolving powder materials such as coffee in hot water, with sugar and milk added therein if necessary. Similarly, the ice making machine may supply ice in the cup held by the cup holding unit 5 through ice discharging hose 11 in accordance with the selection made by the consumer.

When such drink and ice are supplied to the cup, the cup holding unit 5 is slid in the direction of the arrow A shown in FIG. 2, until it is stopped at the predetermined position shown in FIG. 3. The operation of the cup holding unit 5 is controlled based on the output of optical position sensors provided on the transport route of the cup. A vertical cup transport unit 12 for moving the cup upward carries the cup to a predetermined vertical position.

Figure 5:
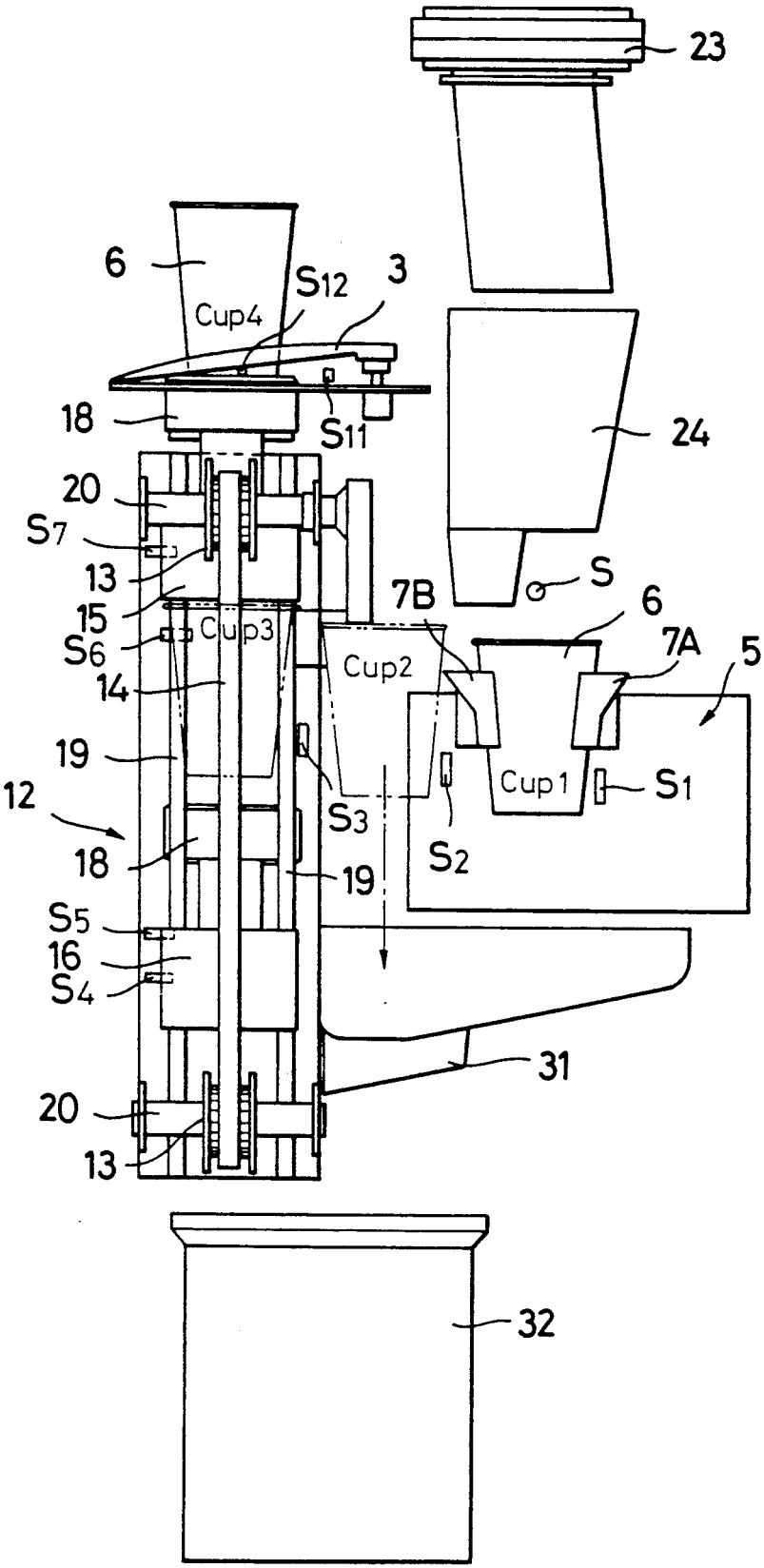
FIG. 5 is a side view of the overall arrangement of the vending mechanism.
Figure 6:
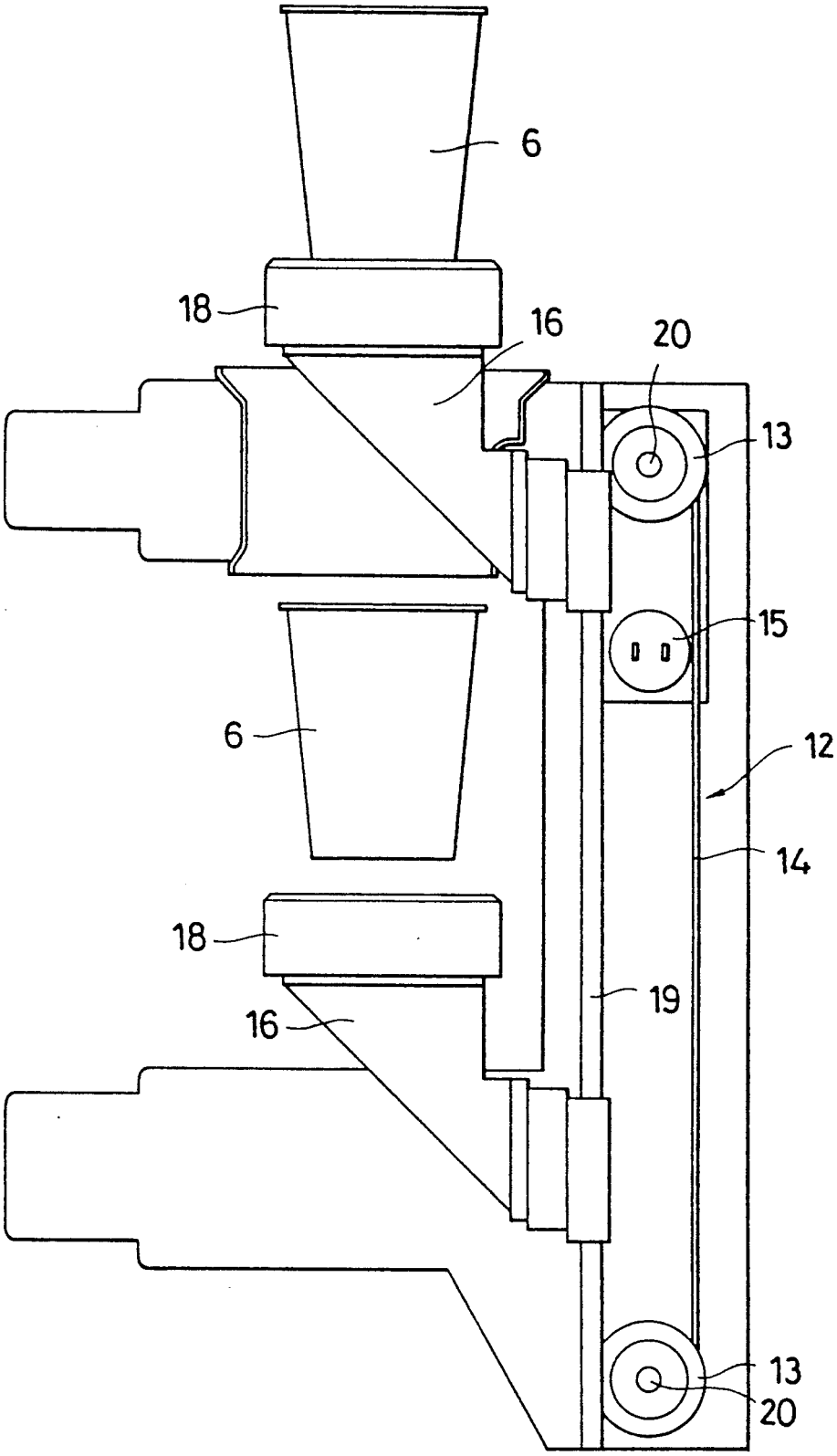
FIG. 6 is a side view of the vending mechanism of FIG. 6 seen from the right side thereof.

As shown in FIG. 5 and FIG. 6, the vertical cup transport unit 12 includes a belt 14 entrained on the upper and lower pulleys 13, a driving motor 15 rotatable in two directions for driving one of the above pulleys, a vertical slider 16 mounted on said belt 14, a cylindrical coaster unit 18 mounted on the top of the vertical slider 16, and a guide rod 19 extending through the base of the vertical slider 16 for ensuring stabilized vertical movement of the coaster unit 18. The pulleys are supported by shafts 20.

Normally, the above coaster unit 18 is located during standby period at a position a little lower than the bottom surface of the cup 6, which is moved in the direction of the arrow A of FIG. 2. As the cup 6 arrives, the driving motor 15 is activated to rotate a little in its normal direction, and the coaster unit 18 moves upward, thereby supporting the bottom surface of the cup to receive the cup thereon. Then, the cup grabbers 7A and 7B are opened to release the cup to the coaster unit 18. Next, the cup grabbers 7A and 7B are opened more widely so as not to hinder the upward movement of the cup 6. Then, the driving motor 15 is again rotated in its normal direction to move the coaster unit 18 up, until the coaster unit 18 is entered in a cup guide unit 21. The cup guide unit 21 is designed to have a larger diameter than the cup for accommodating the cup therein, preventing the cup from falling down.

FIG. 4 shows the drink filled cup 6 coming to the counter table unit 2 of the vending corner 1. As is understood from this figure, the cup 6 is raised from below into the vending corner 1, with the vending door 3 opened to leave the cup outlet 22 open.

As described above, the drink is offered to the consumer in the following sequence: Holding the cup released from the cup supplying unit→Injecting drink into the cup→Moving the cup to the vertical cup transport unit after drink is injected→Transferring the cup to the vertical cup transport unit→Moving the cup upwardly→Carrying the cup to the vending corner.

The overall flow of this vending operation is indicated in FIG. 5. Specifically, upon receiving a vending command, a cup dropper 23 is operated to allow the cup to pass through a cup chute 24. The cup is grabbed by the cup grabbers 7A and 7B, after which the cup is filled with drink injected from the drink injection nozzle 10. Then, the entire cup holding unit 5 is moved sidewards through the positions indicated as Cup 1, Cup 2, and Cup 3. At the position of Cup 3, the cup is transferred to the vertical cup transport unit 12 and is lifted up to the position of Cup 4.

If the released cup is improperly grabbed by the cup grabbers 7A and 7B or held in an angled position between the cup grabbers 7A and 7B, such improper condition is detected by a cup detecting sensor S installed immediately above the cup holding unit 5. The sensor S generates a cup blocking signal indicative of improper arrangement of the cup as such cup interrupts the light beam generated by the sensor S.

When the cup blocking detecting sensor S detects such a trouble as mentioned above, the cup grabbers 7A and 7B are loosened slightly so that the cup is placed in normal position between the cup grabbers 7A and 7B. In addition to the cup grabbers 7A and 7B, a cup rest (not shown) is provided to support the bottom surface of the cup. This cup rest is provided, for example on the rails 8. Further, it is designed to be freely movable upward and downward so that, even when a cup with different height is used, the top of the cup is always aligned with the cup grabbers 7A and 7B.

In order to prevent falling down of the cup 6 or spilling of drink caused by contact of the cup rest with the cup 6 during cup transport, the cup is moved not in an exact upright position along the rail 8 but moved in a slightly tilted condition (tilt about 5 degrees) with respect to a vertical line while ascending the rails. A cup disposal outlet 31 and a drain bucket 32 are provided below the position of Cup 2. The drink prepared in the cup during a power failure should not be sold for a hygienic reason. Furthermore, it hinders subsequent sale if it remains. Accordingly, wherever the cup is on the transport route, such cup is moved to the position of Cup 2 when the power is restored, and disposed of by being taken away by opening the cup grabbers 7A and 7B.

If power failure has occurred when the cup is in the ascending process from the position of Cup 3 to position Cup 4, the vertical cup transport unit 12 is moved in a reverse direction to lower it when power is restored. It is then transferred to the cup grabbers 7A and 7B at the position of Cup 2 and is taken away. In so doing, it is thus possible to take remedial actions in case of power failure during vending operation and to offer only fresh drink to the customer, allowing the machine to continue its vending operation.

Next, the arrangement of the cup holding unit 5 and a horizontal cup transport unit 50 for moving the cup holding unit 5 in the forward and backward direction of the automatic vending machine shown in FIGS. 7 and 8. As briefly described previously, the cup holding unit 5 is provided with a slider unit 9 which is slidably mounted on the rails 8. Further, this slider unit 9 is furnished with a cup holder 25 having a pair of cup grabbers 7A and 7B.

The slider unit 9 is driven by a driving unit 9A for reciprocal motion on the rails 8. The driving unit 9A has a pinion 27 engaged with a rack 26 on the back of the rails 8 and a driving motor 28M. The slider unit 9 also has two sets of paired rollers 29 for supporting a projection 26A having a rack 26 by pinching the upper and lower sides of the projection 26A, and a pair of rollers which may move rotatably within a roller receiver 35 installed on the lower end of the rail 8.

Figure 9:
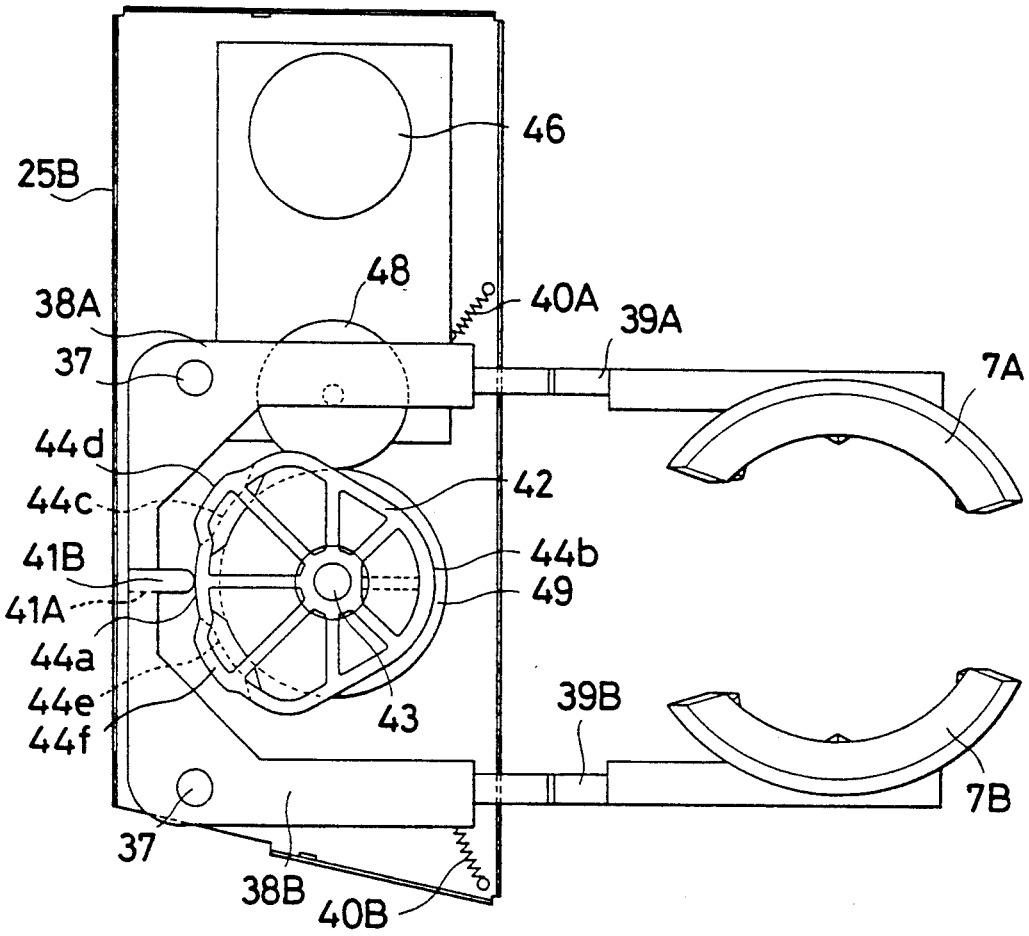
FIG. 9 is a plan view of the cup holding unit.
Figure 10:
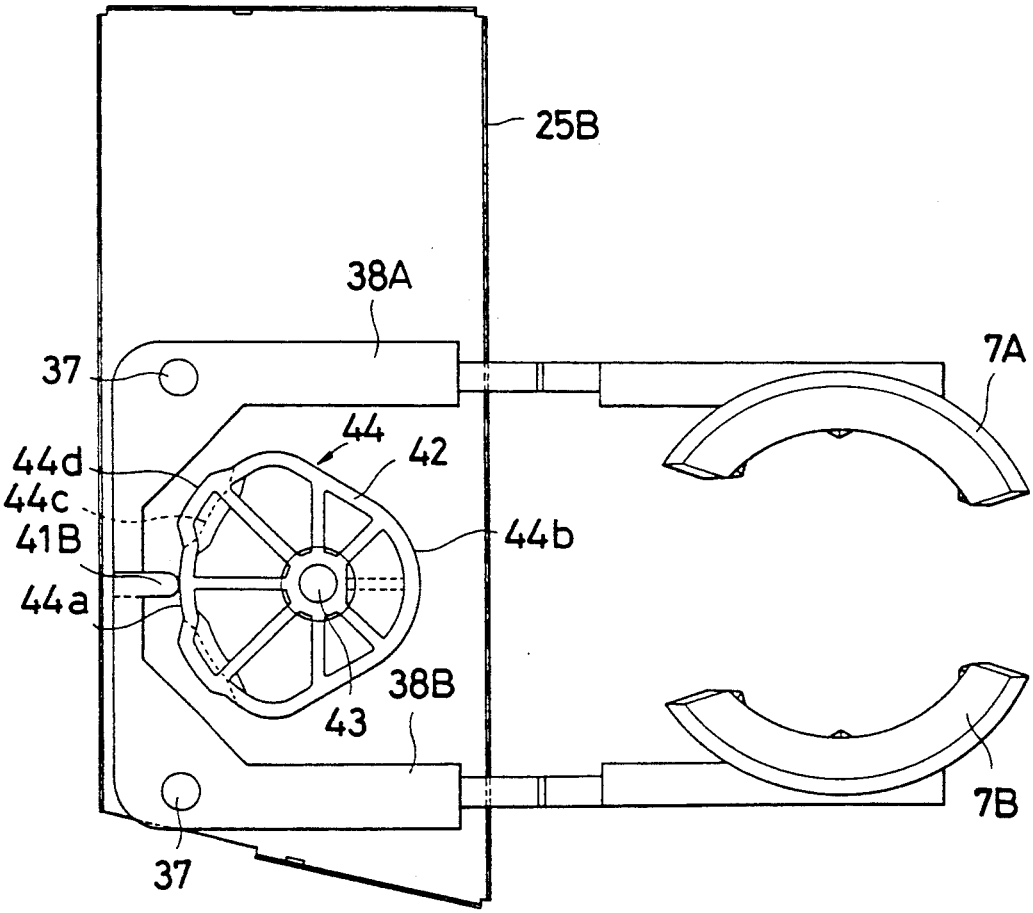
FIG. 10 is a plan view of the cup holding unit waiting for a cup to be filled with a drink.
Figure 11:
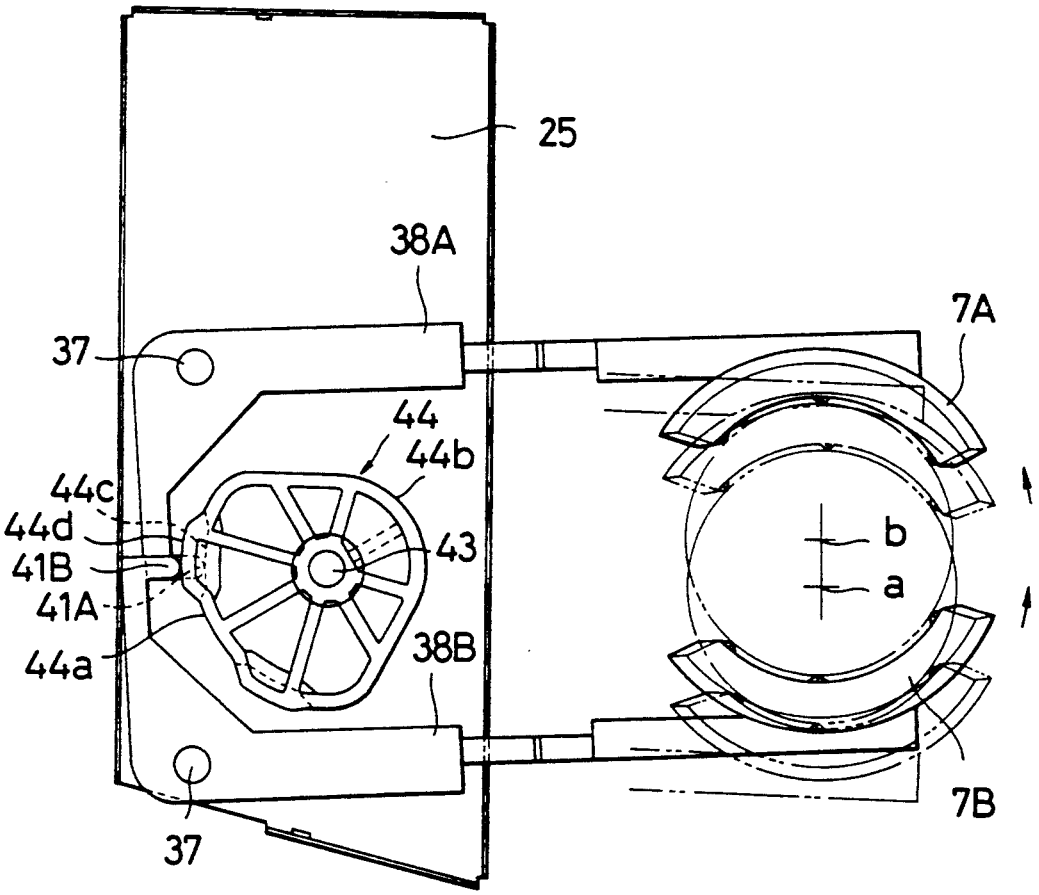
FIG. 11 is a plan view of the cup holding unit when it is slightly moved towards a drink injection nozzle after the cup holding unit has held the cup.
Figure 12:
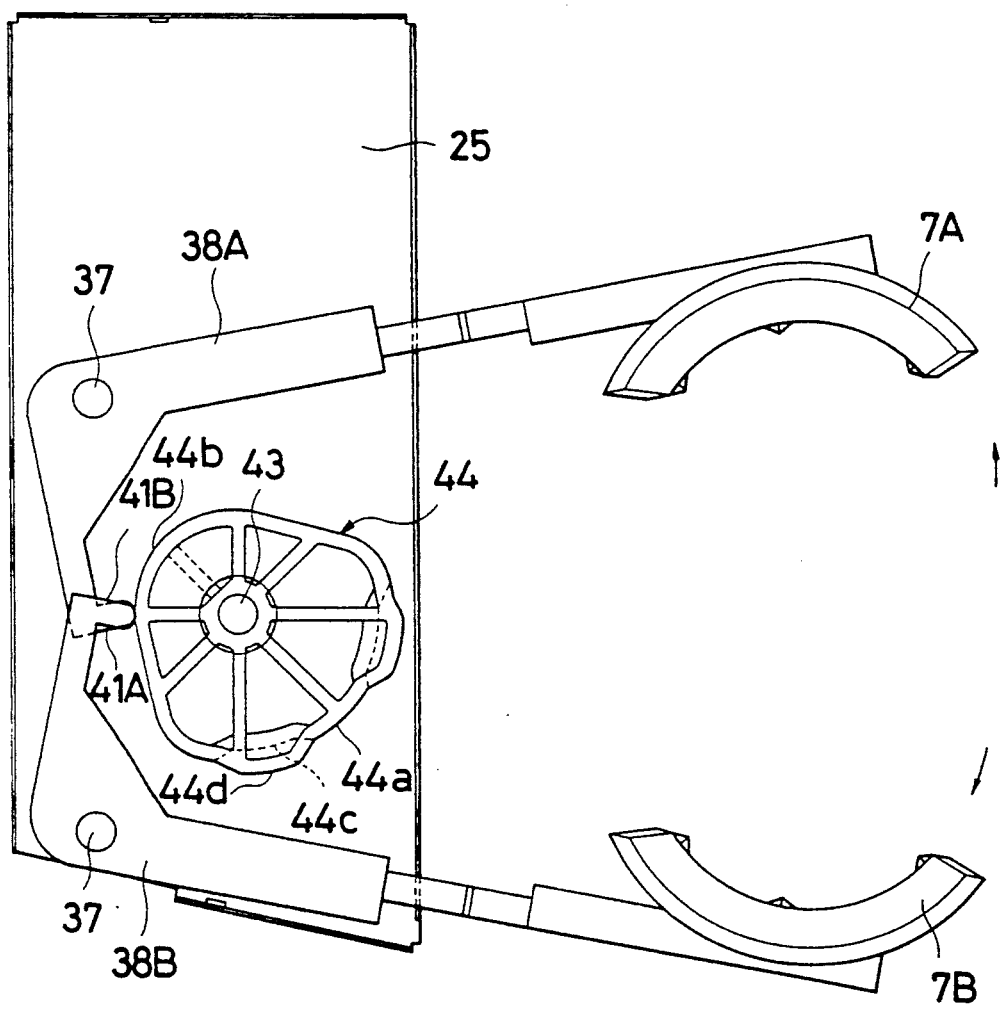
FIG. 12 is a plan view of the cup holding unit releasing the cup.

The cup grabbers 7A and 7B are each connected at their respective end with one ends of the operating levers 38A and 38B, respectively, pivotally supported on a pair of shafts 37 and 37 which are installed on the base 25A of the cup holder 25, through arms 39A and 39B as shown in FIGS. 9–12. The operating levers 38A and 39B are pushed by the spring 40A and 40B mounted on the upper base frame 25B of the cup holder 25 in opposite directions. The other rotating ends of the operating levers 38A and 38B are bent toward each other and are provided at their ends with projections 41A and 41B which are in contact with the cam 42. The projection 41B on the operating lever 38B is provided above the projection 41A of the operating lever 38A. The peripheral surface of the cam (hereinafter referred to as cam surface) 44 is composed of; smooth cam surfaces **44*a* and 44*b* in contact with the projections 41A and 41B, respectively, as shown in FIGS. 10 and 12; a concave cam surface 44*c* in contact with the projection 41A; and a convex cam surface 44*d* in contact with the projection 41B. The cam surface 44*d* shown by solid line is provided above the cam surface 44*c* shown by the broken line. Since these cam surfaces 44*a*, 44*b*, 44*c* and 44*d* are at different distances from the center of the cam shaft 43, the open distance between the cup grabbers 7A and 7B varies according to the angular position of the cam. The upper cam surfaces 44*c* and 44*d* as well as lower cam surfaces 44*e* and 44*f* correspond to the cam surfaces 44*c* and 44*d* have larger radial distance from the cam shaft 43 to permit, depending on the size of a cup, changes in the distance between the cup grabbers 7A and 7B. The cam 42 is rotated by the cam driving unit 45 in the range of $+180°$ to $-180°$ with respect to the standby position or status shown in FIG. 10. The cam driving unit 45 includes a driving motor 46, a speed reducing device 47, a driving gear 48 and a cam driving gear 49. The gear 49 is securely mounted on a lower portion of the cam rotating shaft 43 of the cam 42**.

The mechanism and the operation of the cup grabbers 7A and 7B in the cup holding unit 5 as described above can be better understood in reference to the plan view, FIG. 9, of the cup holding unit 5 and FIGS. 10 and 12 showing its operation. As shown in each of these figures, since the projections 41A and 41B of the rotating ends of the cup grabbers 7A and 7B are in contact sequentially with the concave and convex cam surfaces **44*a*, 44*b*, 44*c* and 44*d* (or 44*a*, 44*b*, 44*e* and 44*f*), and the grabbing operation by the cup grabbers 7A and 7B is controlled by the reciprocal angular movements of the cam 42** over a given rotational domain.

In other words, in an example shown in FIG. 12 where the projections 41A and 41B are in contact with the cam surface **44*b* having a smaller distance from the cam shaft 43, the operating levers 38A and 38B can swing fully about their shafts 37, in opposite directions under the tensions of the springs 40A and 40B, thereby opening the cup grabbers 7A and 7B**.

When the projections 41A and 41B are pressed against the protruding cam surfaces **44*a* and 44*d* having a larger distance from the cam shaft 43, as shown in FIGS. 10 and 11, the operating levers 38A and 38B are rotated less so that they are in closer proximity to each other under the forces of the springs 40A and 40B. A cup may be grabbed by the cup grabbers 7A and 7B** under this condition.

As described above, the cup grabbing operation by the cup grabbers 7A and 7B is controlled by the cam motion of the projections 41A and 41B on the cam surface 44. FIG. 10 shows the condition of the grabbers in standby status or standby position where the cup supplied is received and grabbed by the grabbers. The projections 41A and 41B are at the same rotational, but upper and lower, position, respectively, and are in contact with the common cam surface **44*a*, keeping the operating levers 38A and 38B** parallel to each other.

It is shown in FIG. 10 that for easy reception of a cup supplied and dropped in between the grabbers 7A and 7B, the cup grabbers 7A and 7B are opened wider by 2–3 mm than the diameter of the grabbed portion of the cup.

Figure 13:
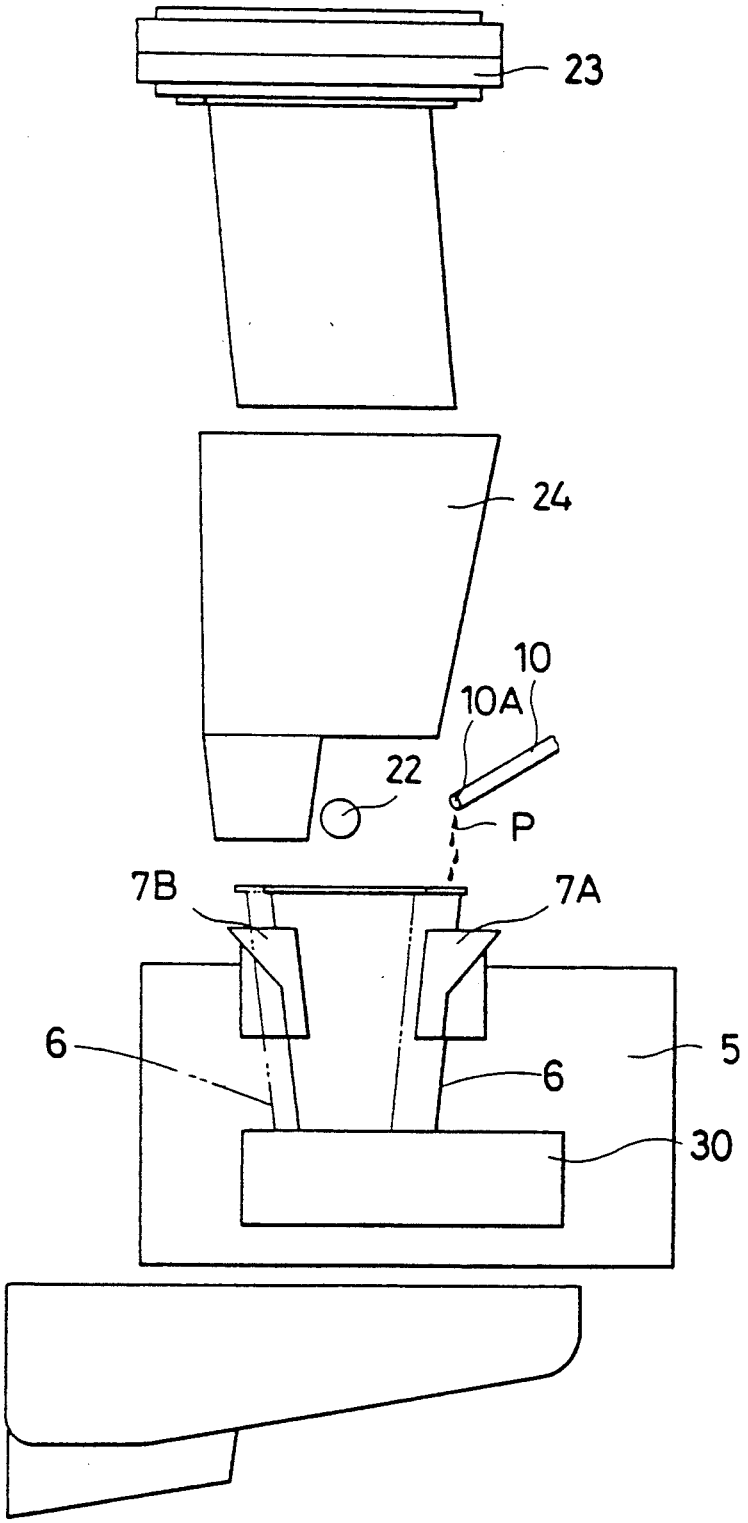
FIG. 13 schematically illustrates the arrangement of the essential part of the vending mechanism, showing that the cup holding unit has moved, after grabbing a cup, towards the drink injection nozzle.

FIG. 11 shows that the cup received is displaced from position "a" to position "b" under the drink injection nozzle. With such small displacement, it is possible to receive drink P dripping from the drink injection nozzle 10 completely into the cup as shown in FIG. 13, and also to prevent contaminating the cup and grabbers. This operation is performed as follows:

When the cam 42 is rotated counterclockwise from the position shown in FIG. 10, the projection 41A of the operating lever 38A is brought into contact with the cam surfaces **44*a* to 44*c*, and the projection 41B of the operating lever 38B into contact with the cam surfaces 44*a* to 44*d*. This process makes the cup grabber 7A close a little in accordance to the size of the cup, to thereby grab the cup. The cup grabbers 7A and 7B are then angularly displaced a little further in the same direction (the direction of the arrow in FIG. 11) about the supporting shafts 37 pivotally supporting the base ends of the operating levers 38A and 38B. The displacements or strokes of the levers take place towards the drink injection nozzle 10. The strokes are different for the two cup grabbers 7A and 7B. Different strokes may be attained by, for example, allowing a larger displacement for the cup grabber 7B than for the cup grabber 7A, to thereby grab the cup and at the same time displace the center of the cup 6 from the point "a" (cup dropping position) to the point "b" (drink injection point) in FIG. 11**.

As a result, the cup 6 is moved from the position shown by two-dot phantom circle in FIG. 13 to the position of the solid circle, so that the cup 6 is placed right below the nozzle outlet 10A of the drink injection nozzle 10. The drink from the drink injection nozzle 10 is injected into the cup 6, and drink P, if any, dripping from the nozzle at the end of the injection falls into the cup 6, so that spilling of the drink out of the peripheral portion of the cup will not take place.

In order to ensure firm grabbing of the cup, an additional force is applied to the cup grabbers 7A and 7B against the force of the springs 40A and 40B as compared to the case of FIG. 10. The cup grabbers 7A and 7B are brought closer to each other, and then integrally moved toward the drink injection nozzle 10.

FIG. 12 shows the cup grabbers 7A and 7B opened to release the cup, with both projections 41A and 41B being in contact with the cam surface **44*b***.

In order to control opening/closing motion of the cam grabbers 7A and 7B by controlling the rotation of the cam 42, a rotating disk (not shown) is provided on top of the cam 42, and a projecting plate (not shown) is provided on the rotating disk. A plurality of sensors for detecting the rotational angle of the rotating disk are provided on the peripheral portion of the projected plate. The rotational angle is detected when the projecting plate traverses a given light beam. In such arrangement, the detection of the angular position of the cam 42 in reference to the standby position thereof permits judgement of the conditions of the cup holding unit 5, in particular if the cup grabbers 7A and 7B has grabbed or released the cup. Therefore, it is possible to control the operation of the cup grabbers 7A and 7B based on the detection.

The operation of the cup type automatic vending machine having the above arrangement is now discussed.

The distance between the cup grabbers 7A and 7B of the cup holding unit 5 is adjusted so as to grab any cup of any size. The height of the cup rest 30 is also adjusted for the same purpose.

When a coin is deposited in a coin slot and a choice is made by the customer for a desired drink, a vending signal indicative of the choice is generated, which causes the cup supplying unit to release a cup to the cup holding unit throught the cup chute 24. The cup is held there. Should the cup be trapped within the cup chute 24 or held improperly, e.g. tilted in the cup holding unit 5, the cup detecting sensor S detects such trouble, and a measure is taken to stop the current vending operation or the adjust the width of the cup grabbers 7A and 7B so that the grabbers may regrab the cup properly. After the cam driving unit 45 is started to operate, the cup 6 is moved to the position, shown in FIG. 11, closer to the drink injection nozzle 10. At this position, ice and/or drink, supplied from the ice making machine and/or drink supplying unit, respectively, is injected into the cup 6. Following the injection of the drink, the cup is transferred to the vertical transport unit 12 by the driving unit 9A as shown in FIG. 8. This transfer is completed when the coaster unit 18 of the vertical cup transport unit 12 receives the cup by supporting thereon the bottom surface of the cup 6. The cam driving unit 45 is then operated again to open the cup grabbers 7A and 7B as shown in FIG. 12, freeing the cup 6 on the coaster unit 18. After the transfer of the cup is completed, the vertical cup transport unit 12 is moved upward again to lift up the coaster unit 18. The cup grabbers 7A and 7B are brought to the standby positions for the next vending operation. The vending door 3 and the cup outlet 22 are opened during the upward movement of the coaster unit 18. The cup 6 placed on top of the coaster unit 18 is brought to the vending corner 1 and remains on the coaster unit 18. Therefore, the customer can easily take the cup out from the vending corner 1 by simply grabbing the cup lightly. Moreover, the customer does not have to bend or crouch to remove the cup because the vending corner 1 is positioned at a higher position than in the conventional type vending machine. After the cup 6 is taken out, the coaster unit 18 is lowered to the original position and is brought to the standby position for the transfer of the next cup. This completes a sequence of vending operations.

If the operation is stopped after the injection of drink, i.e. during horizontal and vertical movements of the drink filled cup, for some reason such as power failure, the drink filled cup is moved to a container for disposition when the operation is resumed.

Next, possible troubles that may me encountered during the delivery of a cup 6 from the cup dropper 23 to the cup grabbers 7A and 7B are discussed. Such troubles are recognized when: a) no cup comes out at all; b) a cup is trapped in the cup chute; c) a cup is trapped in the cup grabbers; d) a cup is not grabbed properly, e.g. due to tilting or deviation of the cup from the right position, so that the drink is spilling.

Figure 14:
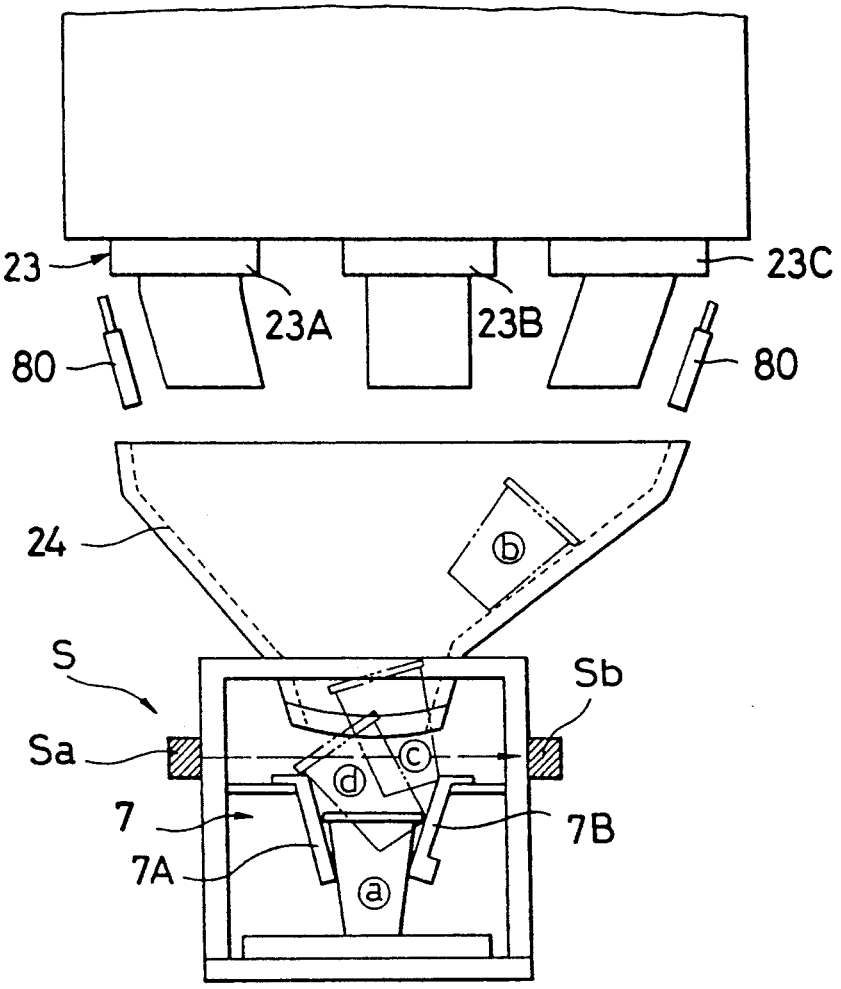
FIG. 14 is a drawing for explaining the nature of the trouble encountered during the cup dropping process.

These troubles are shown schematically in FIG. 14. This figure shows a cup "b" caught in the chute 24, a cup "c" misplaced on the cup grabbers 7, and a cup "d" tilted in between the cup grabbers 7. A cup will be placed properly (cup "a") in upright position within the cup grabbers 7 if no such problems take place.

As mentioned previously, in order to identify a true cause of such trouble, the vending machine of the invention is provided with a cup detecting sensor S, which is mounted immediately above the position where the cup is dropped from the cup dropper 23 is grabbed correctly. By this sensor, it is possible to identify: (1) if a cup is dropped; (2) if the cup is grabbed properly; and (3) a trapping site in case the cup is trapped. The cause of the trouble can be analyzed in detail.

Figure 15:
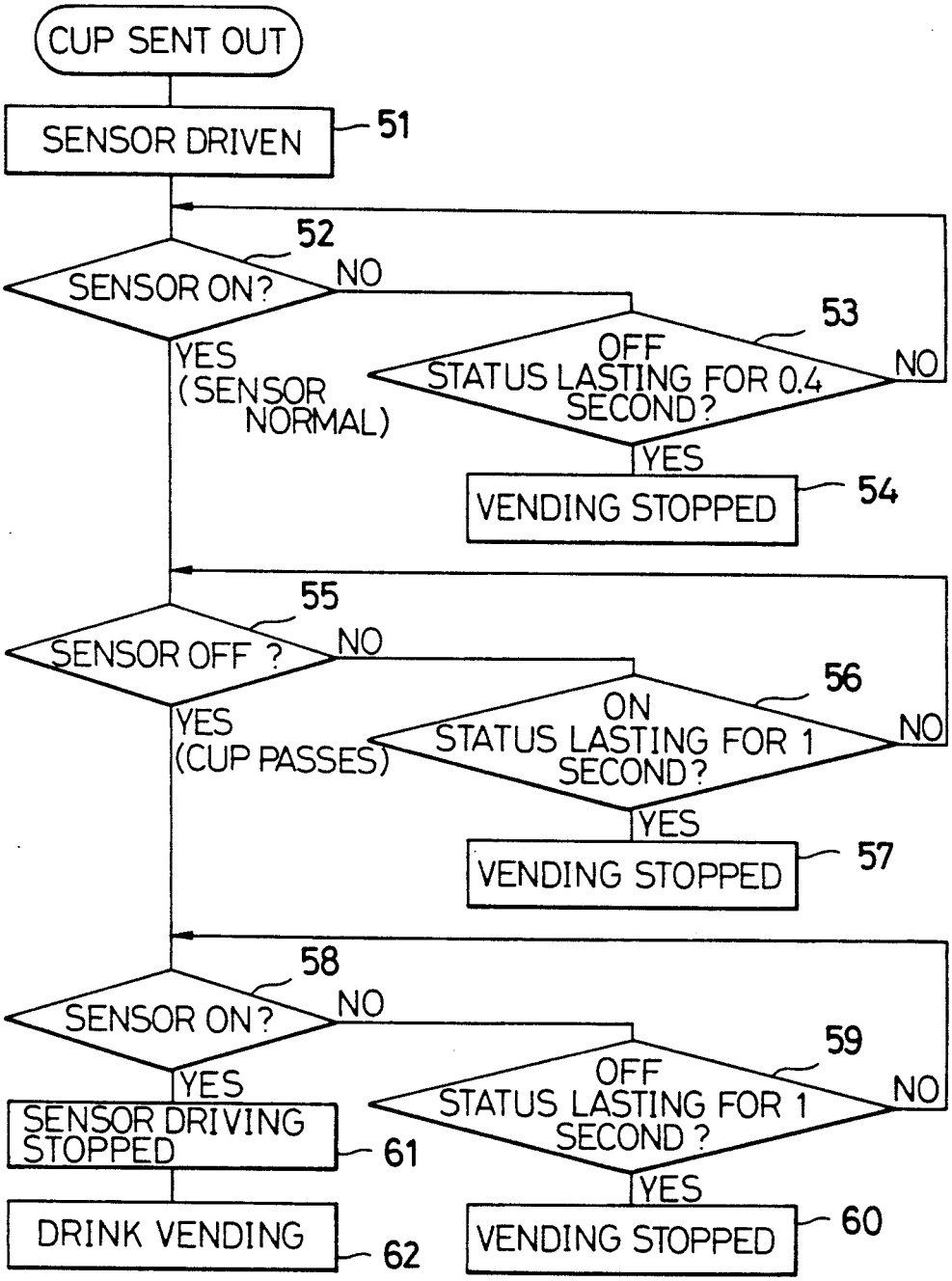
FIG. 15 is a flow chart showing how to identify the nature of the trouble involved in dropping a cup according to the invention.

A transmission type opticl sensor is used as the cup detecting sensor S, which may discern troubles from detection signals indicating how the light beam from a light emitting unit Sa is interrupted by a cup before it reaches a light receiving unit Sb. FIG. 15 is a flow chart for such detection.

In FIG. 15, ON-state of the sensor S corresponds to the situation where the light receiving unit Sb is receiving light, and OFF-state of the sensor S corresponds to the situation where the light receiving unit Sb is not receiving light. After an instruction to deliver a cup is initiated, the sensor S is set in operation (step 51), and a judgement is made if the light receiving unit Sb is turned ON or not (judgment 52). If it is not, then a further judgement is made if the OFF-state lasts for more than 0.4 second (judgment 53).

If the judgment 52 is NO (i.e. the sensor is not turned ON) and the judgment 53 is YES (i.e. the sensor is OFF for more than 0.4 second), the judgements are apparently erroneous, due to perhaps malfunction of the sensor itself or presence of a foreign object stuck in the sensor. Therefore, the vending operation is stopped in this case (step 54).

If the judgment 52 is YES, the sensor is functioning. Then, the state of the sensor is checked (judgment 55). If the sensor is in OFF-state, a next judgment 58 is carried out. If it is in ON-state, an observation is made if the ON-state lasts more than 1 second (judgment 56).

When the a cup passes across the sensor S in normal condition, the sensor is turned off, yielding YES in the judgment 55.

However, if the judgment 55 is NO, and if the sensor is not turned off from ON status for more than 1 second (YES in judgment 56), it is concluded that the cup to be supplied has not reached to the position of the sensor even after 1 second, so that the cup is either trapped in the middle of the route or the cup has not been released at all. The vending operation is then stopped in this case (step 57).

It is noted that the critical time for making a decision is set to 1 second. This is because 1 second is normally a good time for most cups delivered to the detector point, even when the cups are temporarily trapped on the delivery route.

When the judgment 55 is YES, a next judgement is made whether the sensor is turned ON (judgment 58). If the sensor is not turned ON, a further judgement is made whether of OFF state lasts for 1 second (judgment 59).

In case the judgments 55 and 58 are YES, it is concluded that the cup has been dropped correctly and is grabbed normally by the cup grabbers.

Since the sensor S will be turned OFF at the time the cup 6 start crossing the light beam and turned ON at the time the the cup finished crossing, output signal from the sensor should alternate between OFF and ON. In this case, therefore, the cup 6 is grabbed normally by the cup grabbers 7A and 7B, and drink can be injected. Thus, after stopping driving the sensor (step 61), vending operation is continued (step 62).

However, if the judgment 58 is NO and the judgment 59 is YES, it means that the cup 6 has not completely passed the position of the sensor S.

That is, it indicates that the cup 6 is caught at an upper portion of the grabber 7 or the cup is tilted and not positioned between the grabber 7, the cup blocking the light beam. Therefore, the vending is stopped in this case (step 60).

Here, critical time for judgement is set to be 1 second. This is because improper placement of a cup, e.g. tilted in the grabbers 7, may often be corrected naturally within 1 second, so that the vending operation may be continued.

As discussed above, it is possible to judge whether the cup has been released correctly, and also possible to locate the site of a trouble that has happened. Therefore, an adequate remedial measure may be taken.

When the cup 6 is dropped from the cup dropper 23 to the cup grabbers 7A and 7B, the cup rest 30 supports the bottom of the cup. It is noted that the cup rest 30 is freely movable upward or downward and its height may be adjusted so as to properly receive a cup of any given height. It is also noted that the cups having different sizes are released from the cup droppers 23A to 23C.

The above discussion concerns the method for detecting the site of a cup in trouble. If a cup is found, as discussed above, misplaced in the cup grabbers 7, it can be corrected to restore its normal position by the procedure as shown below with reference to FIGS. 16 to 18.

Figure 16:
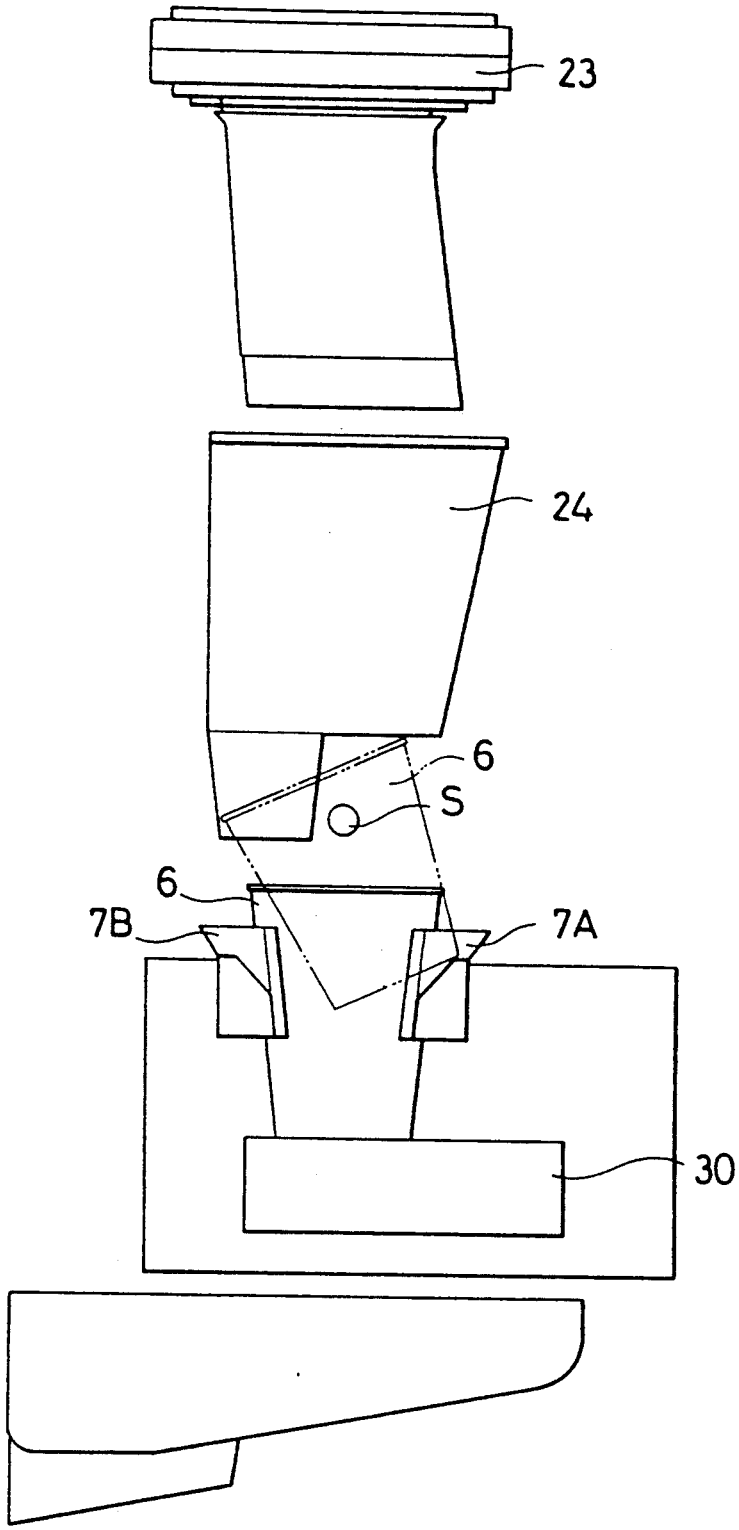
FIG. 16 shows a situation where a cup is trapped on its way from the cup supplying unit to the cup holding unit.

In case the cup 6 coming out of the cup chute 24 failed to sit upright between the cup grabbers 7A and 7B as shown in FIG. 16, the light beam is interrupted continuously, and the signal from the cup detecting sensor S remains unchanged.

Figure 17:
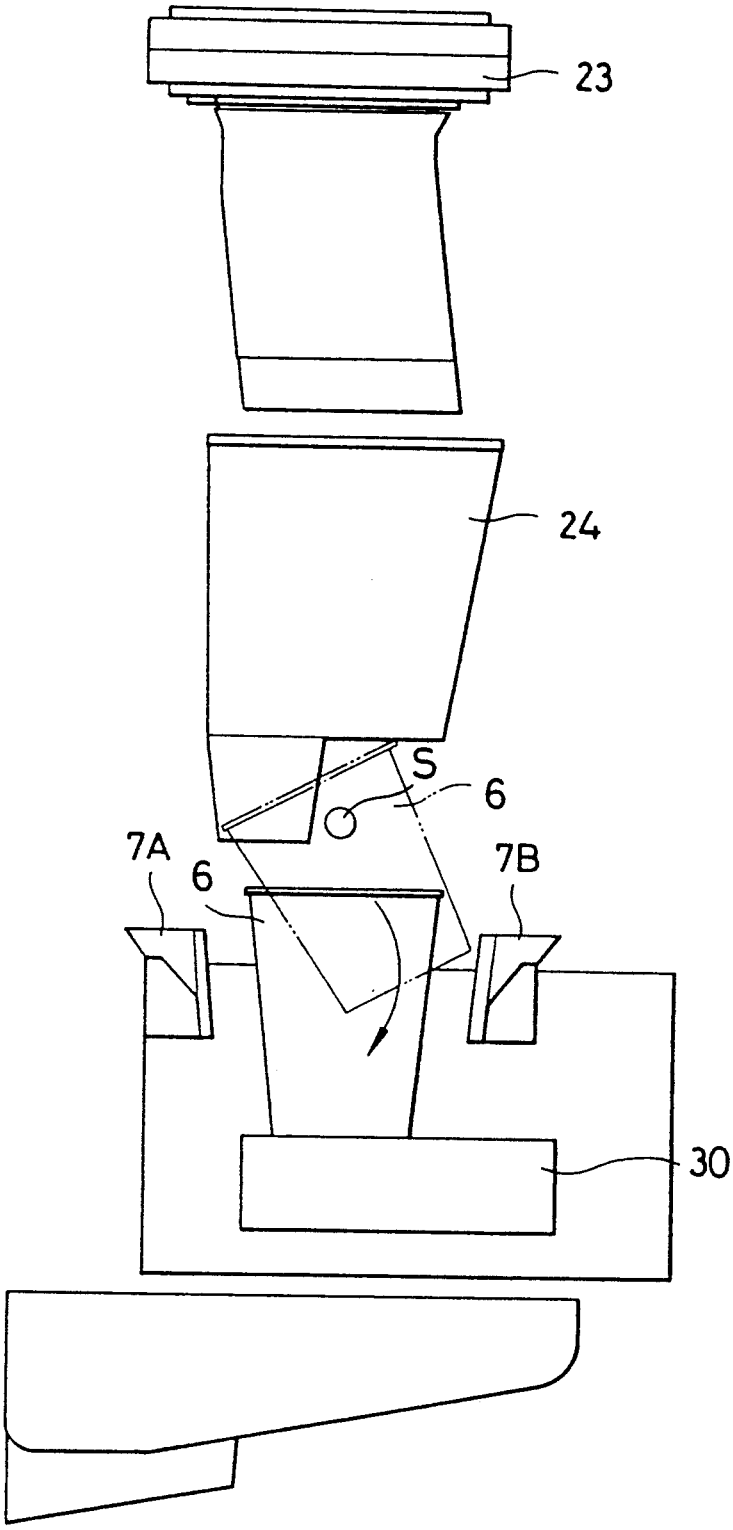
FIG. 17 is a drawing explaining the operation to eliminate the trapping of the cup by opening the cup grabbers.

Then in this case the cup grabbers 7A and 7B are opened as shown in FIG. 17. That is, the cam 42 is rotated as shown in FIG. 12 so that the projections 41A and 41B are brought to the cam surface **44*b*. In so doing, the cup 6, misplaced as shown by two-dot phantom line, will obtain its normal position shown by solid line. The cup is then placed on the cup rest 30 and is grabbed by the cup grabbers 7A and 7B** in correct upright position. Therefore, drink is injected subsequently.

Figure 18:
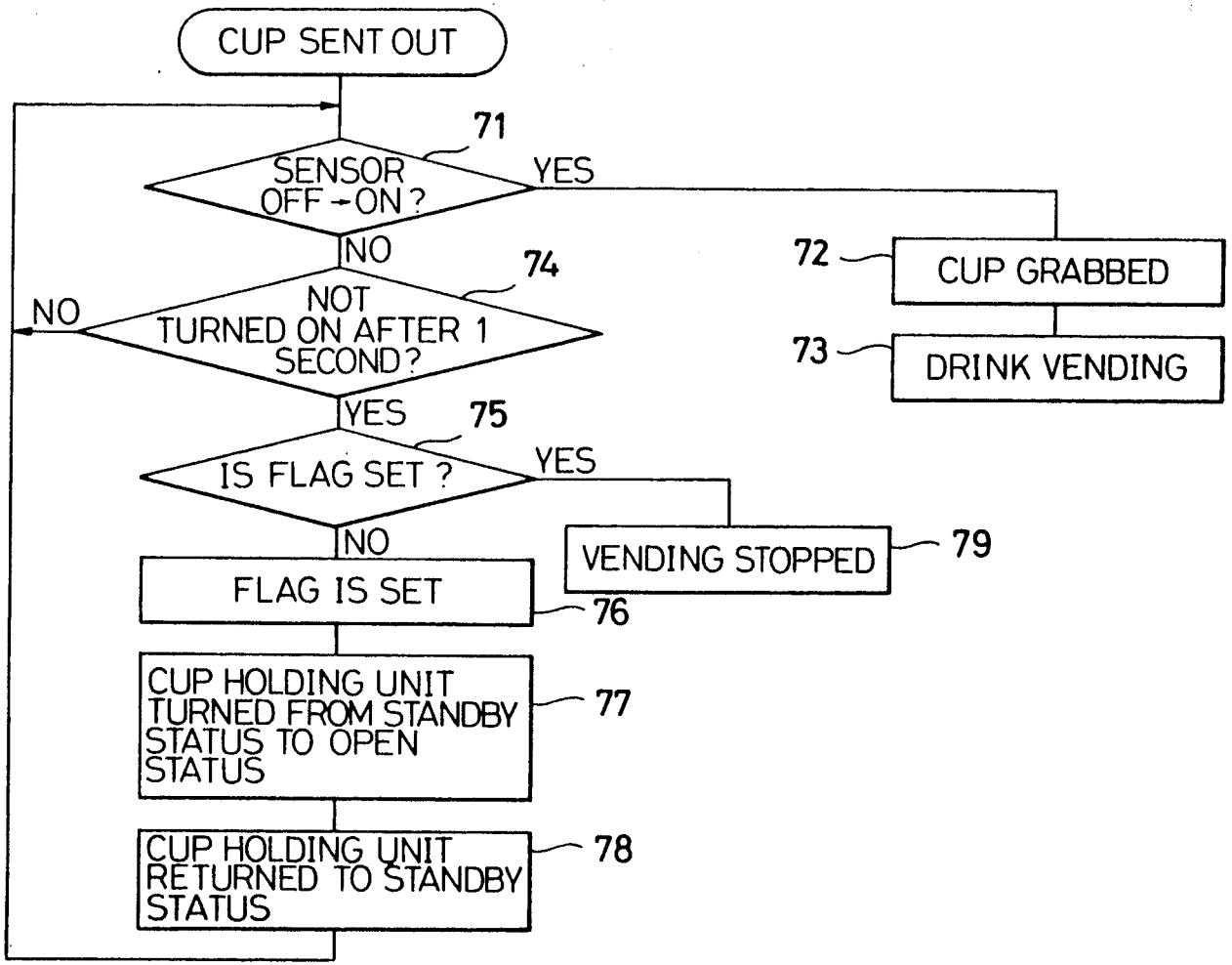
FIG. 18 is a flow chart for the operation shown in FIG. 17.

Control operation required for the above procedure is shown in FIG. 18.

In the flow chart of FIG. 18, the ON-state of the sensor S indicates that the sensor is receiving light in the light receiving unit Sb. On the other hand the OFF-state of the sensor S indicates that the light beam is interrupted and does not reach the light receiving unit Sb.

After the initiation of the operation, the cup detecting sensor S judges whether a change from OFF→ON has occurred (judgment 71). If the cup is dropped correctly in position, the cup will interrupt the light beam once only briefly, thereby turning OFF the sensor for a moment and immediately turning it ON. Thus, the judgment 71 will be YES in that case and it is concluded that the cup is neither tilted nor stuck in the cup holding unit 5. In this case, therefore, the cup holding unit 5 is activated to grab the cup (step 72), and further drink vending operation is continued (step 73).

When the judgment 71 is NO, a next judgement is made if the sensor remains OFF for another 1 second (judgment 74). If the judgment 74 is YES, it is concluded that the cup is stuck on the cup grabbers 7A and 7B, failing to drop correctly. In this case, following a flag check (judgment 75), a flag is set since no flag has been set (76). Then, the cup holding unit 5 changes its state from the standby state to an open state (step 77). This allows the cup 6 to restore upright position on the grabbers and drop vertically from there onto the cup rest 30. The cup holding unit 5 then returns to the standby state to receive the cup (step 78).

After the step 78 judgment 71 is repeated. If it is found in the second step 79 that the cup 6 is held correctly in position, the judgment 71 will be YES. Then step 72 is carried out, and the drink vending operation is continued (step 73).

However, if the cup is found still stuck en route even after the step 77, the judgment 71 will be again NO, and the judgment 74 will be YES. Since the flag remains set, the judgment 75 is YES, and consequently the vending operation is stopped (step 79).

Next, a method dealing with the cup stuck in the cup chute 24 due to, for example stains such as syrup is discussed.

This cup type automatic vending machine may also provide carbonated beverages, so that the machine is provided with a carbonator and carbon dioxide gas cylinder for making carbonated water. The carbon dioxide gas pipe from the gas cylinder is bifurcated to provide the gas to carbon dioxide gas nozzles 80 and 80 above the upper opening of the cup chute 24 and directed thereinto, as shown in FIG. 14.

If a released cup 6 passes past the detecting sensor S within a predetermined period of time, it interrupts the light beam to generate a detecting pulse.

If the interruption does not occur within the predetermined period, no detection pulse is generated, possibly due to the fact that the cup 6 did not drop from the cup chute 24 and remains stuck therein.

In such case, carbon dioxide gas ($CO_2$) from the carbon dioxide gas nozzles 80 and 80 is used to blow the cup off the cup chute 24.

Figure 19:
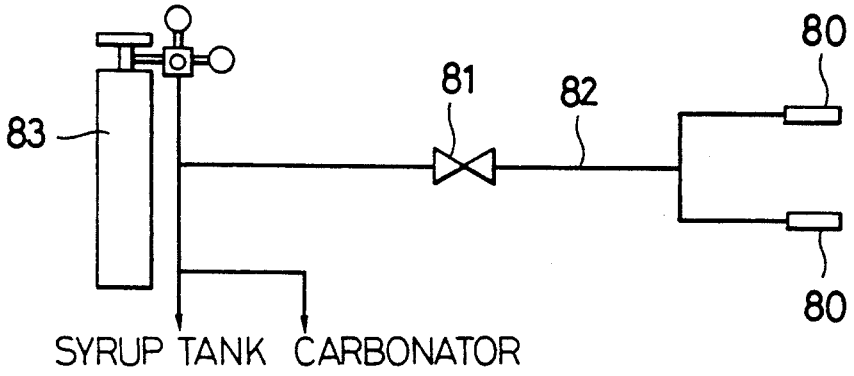
FIG. 19 shows a piping system connecting a carbon dioxide cylinder and carbon dioxide gas nozzles.

FIG. 19 shows the arrangement of the piping between the nozzles and the carbon dioxide gas cylinder containing the gas for manufacturing carbonated water. The carbon dioxide gas is sent from the gas cylinder 83 to the carbonator for making carbonated water and to the syrup tank for pressurizing the syrup to be discharged. Carbon dioxide gas is supplied through a branching pipe 82 to the carbon dioxide nozzles 80 and 80 via an electromagnetic valve 81.

Next, control operation to release the cup trapped in the cup chute 24 is discussed with reference to the flow chart shown in FIG. 20.

Figure 20:
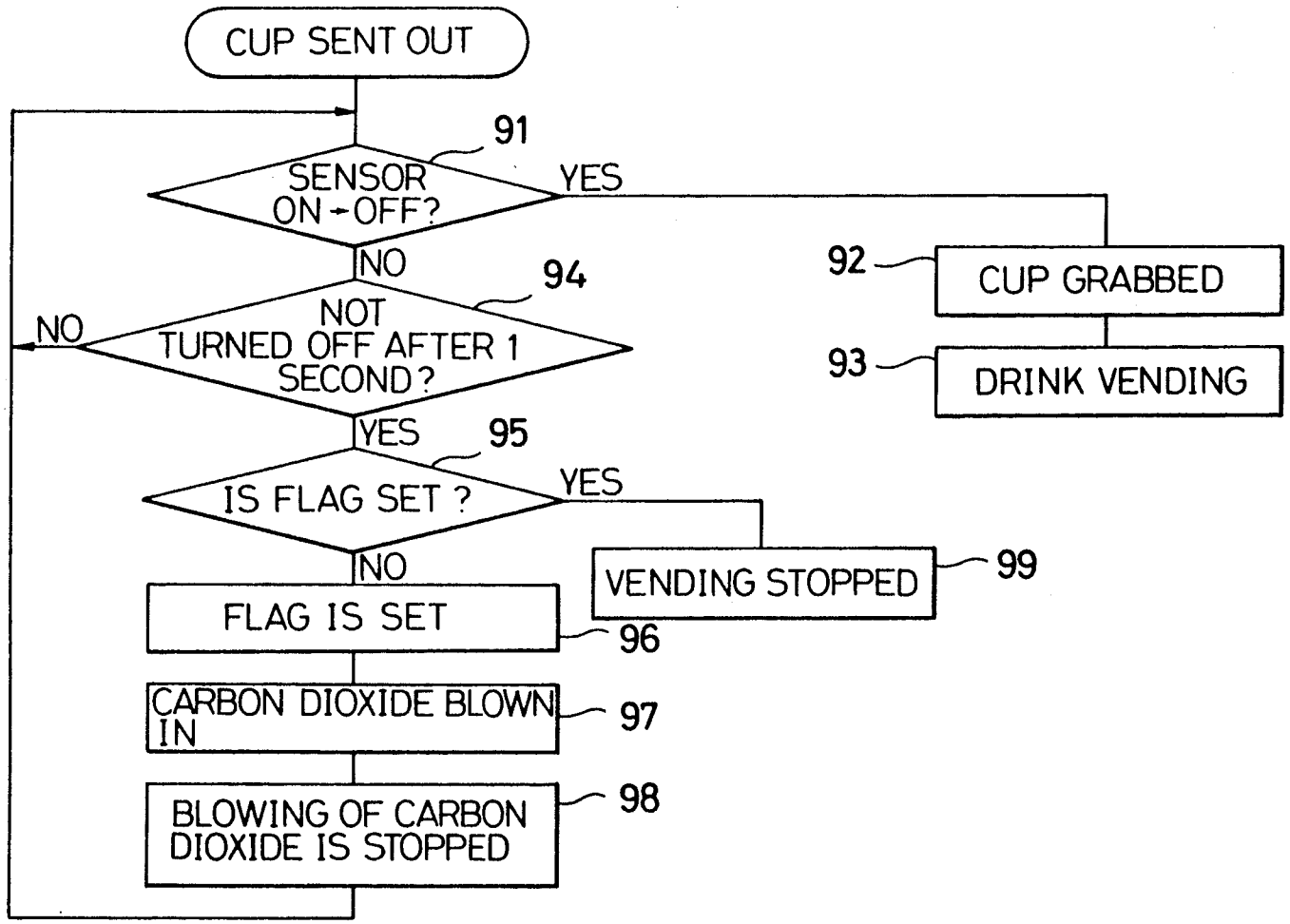
FIG. 20 is a flow chart showing the steps for removing a cup trapped in the cup chute.

In the flow chart of FIG. 20, the ON-state of the sensor S indicates that the sensor is receiving light in the light receiving unit Sb. On the other hand the OFF-state of the sensor S indicates that the light beam is interrupted and does not reach the light receiving unit Sb.

After the initiation of the operation, the cup detecting sensor S judges whether a change from OFF→ON has occurred (judgment 91).

If the cup is not stuck in the cup chute 24 and dropped normally, the judgment 91 is YES. Then, the cup grabbing operation (step 92) of the cup holding unit 5 below the sensor S is performed to carry out further vending operation (step 93). However, if the judgment 91 is NO, and sensor is not turned OFF, and the sensor is kept ON for 1 second with the judgment 94 being YES, it indicates that the cup did not drop past the sensor S in 1 second after it is released, and that it is stuck in the middle of the cup chute 24. In this case, after a flag check (judgment 95), a flag is set (step 96) because no flag has been set. Then, electromagnetic valve 81 is opened to supply carbon dioxide gas ($CO_2$) from carbon dioxide gas nozzles 80 and 80 (step 97) into the cup chute 24, to thereby blowing the cup stuck in the cup chute 24 off the chute. Then, the electromagnetic valve 81 is closed to stop the carbon dioxide gas (step 98).

Subsequent to the step 98, procedures starting from the judgment 91 through 97 are repeated if the cup 6 remains in the chute. When the cup comes out of the cup chute 24, the judgment 91 is turned to YES. Then, the step 92 is carried out and drink vending operation is continued (step 93).

However, in case the cup 6 still remains in the cup chute 24 even after the step 97 has been carried out, the judgment 91 turns out to be NO again, and the judgment 94 YES, the judgment 95 YES since the flag remains set (judgment 95). Then the vending operation is stopped (step 99).

Figure 21:
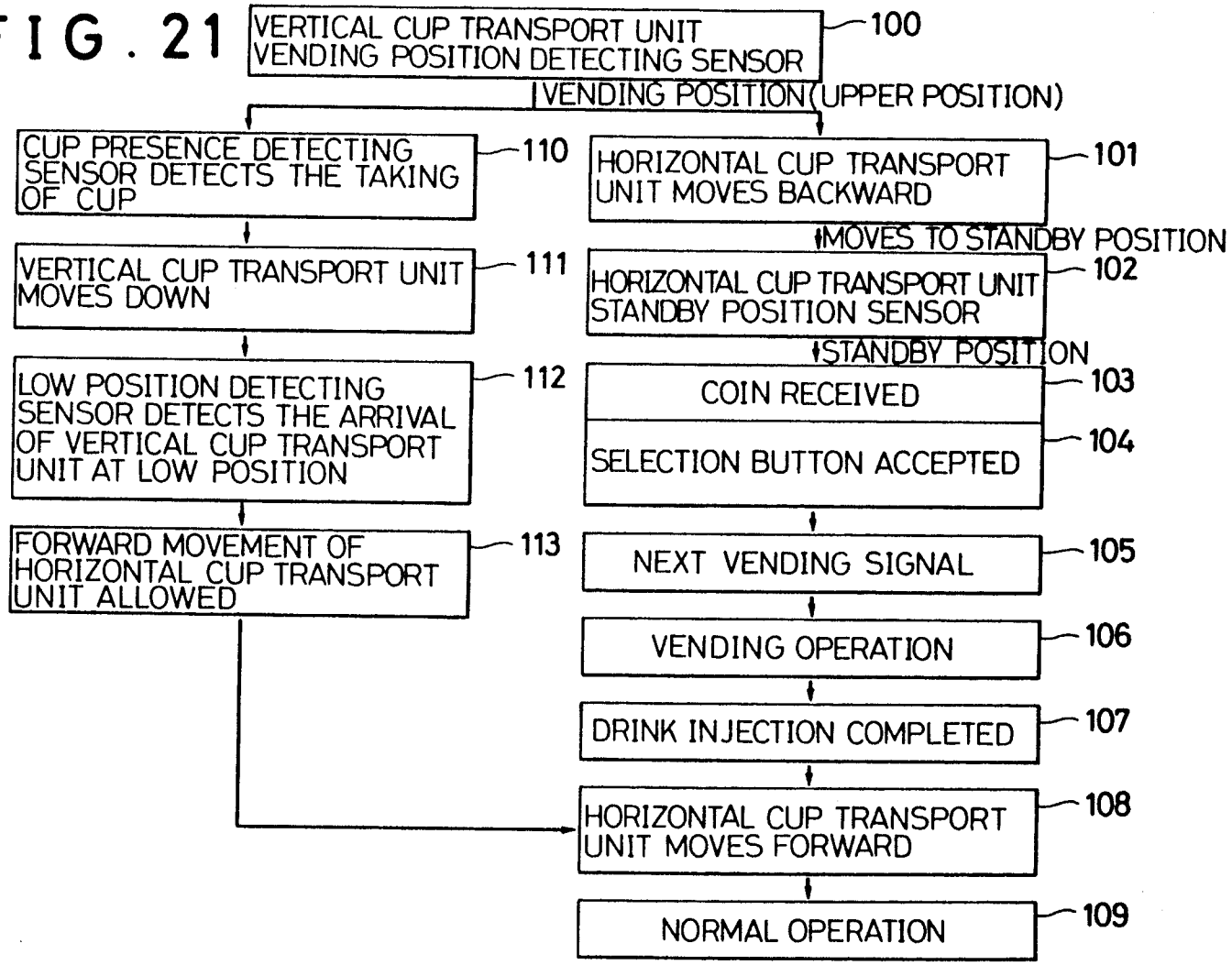
FIG. 21 is a flow chart of the vending operation employed in the cup type automatic vending machine.

Referring to FIG. 21, details of the vending operation are discussed.

When the drink filled cup is lifted by the vertical cup transport unit 12 to the vending corner, it is detected by the vending position detecting sensor $S_7$ as shown in FIG. 5 (100). The cup is stopped at that position, projecting into the vending corner 1. The projecting cup is detected to be "present" by a cup presence detecting sensor S12.

As the vending position detecting sensor $S_7$ detects that the cup has arrived at the vending position, the horizontal cup transport unit 50 recedes (to its standby position) (101). When the standby position sensor $S_1$ (102) detects that the horizontal cup transport unit 50 has returned to the standby position, next purchasing order made by the same customer or different customer may be accepted. That is, coins may be deposited (103) and drink may be selected on the selection buttons 4 (104). When one of the selection buttons 4 is pressed, signals indicative of the next order is issued (105), and the next cup is released from the cup dropper 23. The cup thus released is grabbed by the cup holding unit 5 during injecting drink from the drink injection nozzle 10 in the cup for vending operation (106). The horizontal cup transport unit 50 is standing by for the next move when the drink injection is completed (107).

As the preceding customer takes out his cup from the vending corner 1, the cup presence detecting sensor $S_{12}$ of the vertical cup transport unit 12 detects that the cup was taken out (110). The vertical cup transport unit 12 then moves downward (101). When it reaches the low position for receiving a cup, the low position detecting sensor $S_4$ detects the unit 12 (112). When this low position of the unit 12 is detected by the detecting sensor $S_4$, the horizontal cup transport unit 50 is allowed (113) to move forward. However, the horizontal cup transport unit 50 may move forward provided that the drink injection has been completed (108). The cup is moved onto the coaster unit 18 of the vertical cup transport unit 12 waiting for the cup at the low position. Then, the cup is moved upward following the normal lifting procedure (109), up to the vending position and protrudes into the vending corner 1. The unit 12 is then returned to the initial state (100) to prepare for the next operation.

In this way, the vending operation for the next vending such as depositing a coin, selection of a drink, and injection of drink into the next cup may be performed in advance on the condition that the cup for the present customer is transported to the vending corner 1, saving preparation time (or waiting time) for the next customer. Subsequent operation may be started as soon as the present customer takes up his cup. This is in strong contrast to conventional machines which may start the entire operation only after the customer takes his cup. It is thus a great advantage of the invention that the waiting time is significantly reduced for the customer, as compared with the conventional vending machines.

In the cup drink vending system as described above, if power failure occurs during the transport of the cup filled with drink 6 in the sequence Cup 1→Cup 2→Cup 3→Cup 4 as shown in FIG. 5, the drink filled cup remains in the machine. It is not recommended to sell the cup even after power failure is restored for hygienic reasons. Further, such stagnation of the cup hinders subsequent vending operation. Also, in case the horizontal cup transport unit 50 and the vertical cup transport unit 12 are stopped during the operation before returning to the standby position, a problem arises in that the machine is not prepared for the next vending operation.

To resolve such problem, the invention provide the following measures:

(I) If the operation was stopped during cup transportation, cup grabbers 7A and 7B are opened to free and dispose the drink filled cup in the cup disposition outlet 31 provided intermediate the horizontal transport route after power failure is restored, and the cup holding unit 5 and the coaster unit 18 are automatically returned to the predetermined standby position.

(II) If the operation was stopped before any cup transportation, the units are automatically returned to the predetermined standby position promptly.

The automatic vending machine is designed to judge the nature of the trouble it has encountered and judge if it is possible to recover its normal condition or not, and, if it is, the above mentioned self-control operation (I) and (II) are performed and returns to the standby condition.

In addition to power failure, the transport units 50 and 12 can be stopped for some other reasons such as malfunctions of the sensors $S_1$ to $S_7$.

The control operation of the transport units 50, 12 and 5 will be now discussed below.

First, it should be noted that the cup holding unit 5, the horizontal cup transport unit 50, and the vertical cup transport unit 12 are not operated simultaneously. That is, when any one of these units is operated, the remaining units remain stopped in certain non-operating conditions. Therefore, it is possible to judge the operational condition (operating mode) of the operating unit from the operational conditions (operating modes) of the remaining units. Possible combinations of such operational modes are shown in FIG. 23.

Figure 22:
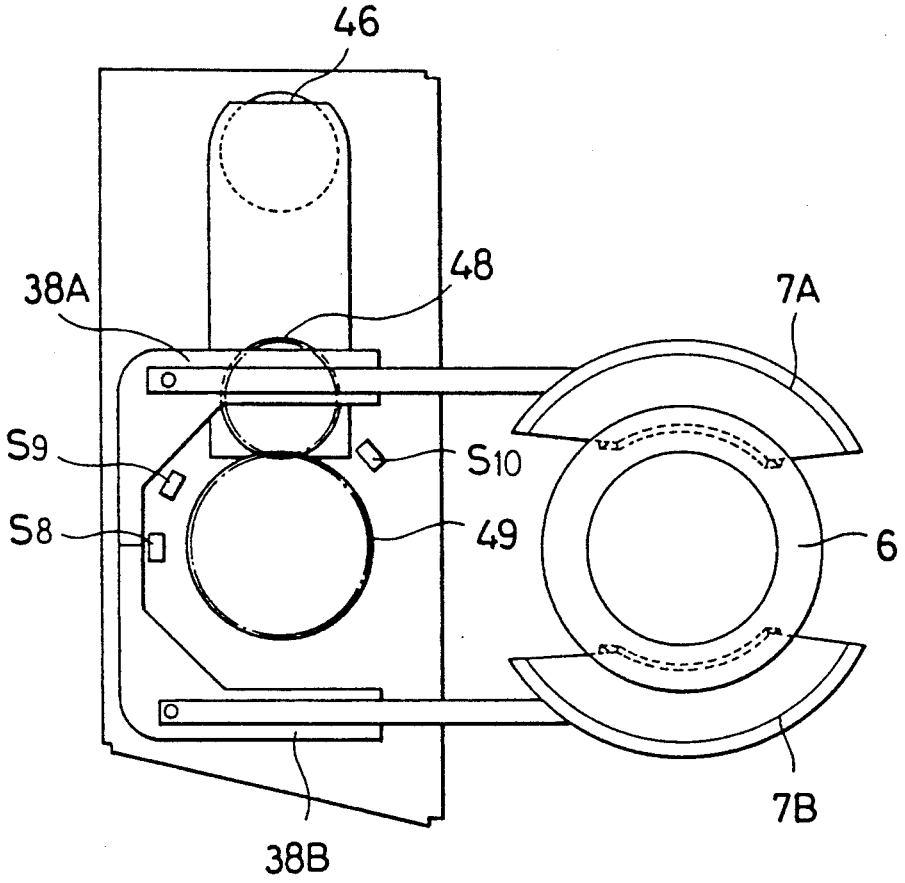
FIG. 22 is a plan view of the cup holding unit provided with a stop position detection sensor.

These modes are judged by the detection signals received from the sensors $S_8$–$S_{10}$ associated with the cup holding unit 5 in FIG. 22, the sensors $S_1$–$S_3$ associated with the horizontal cup transport unit 50 of FIG. 5, the sensors $S_4$–$S_7$ associated with the vertical cup transport unit 12, and the sensor $S_{11}$ associated with the vending door 3.

Next, details of the operations of the horizontal cup transport unit 50, the vertical cup transport unit 12, and the cup holding unit 5 after the drink injection will be now discussed below.

Figure 24:
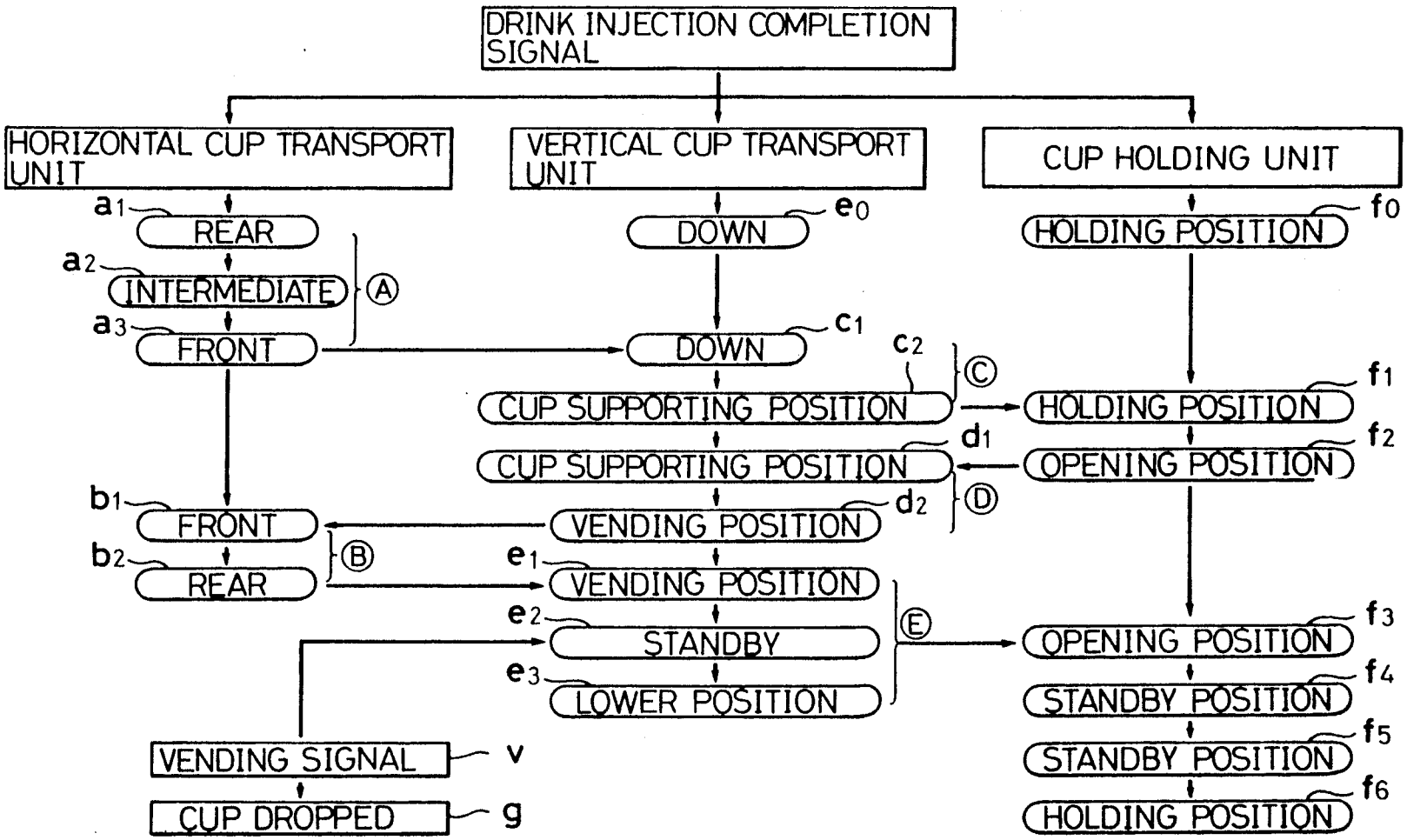
FIG. 24 is an overall flow chart of the operation of the horizontal cup transport unit, vertical cup transport unit, and cup holding unit after the completion of injection of drink.

FIG. 24 shows the flow of normal operations of these units 50, 12 and 5.

When a drink injection completion signal is given, the horizontal cup transport unit 50 sequentially takes positions: rear position a1→intermediate position $a_2$→front position $a_3$. During these steps A, the unit 50 has a cup and is transporting it forward. On the other hand, the vertical cup transport unit 12 is moved to the a position ($e_0$) and remains there. When the horizontal cup transport unit 50 arrives at a front position ($a_3$), the vertical cup transport unit 12 moves slightly upward, taking positions: low position $c_1$→cup supporting position ($c_2$), and receives the cup thereon. In step C, a cup is also present in the unit. On the other hand, when the coaster unit 18 comes to a position where it can support the cup, the cup holding unit 5 undergoes an opening operation by taking: holding position $f_1$→opening position $f_2$. As a result, the cup is completely transferred to the coaster unit 18. The vertical cup transport unit 12 moves upward from a cup supporting position $d_1$ to the vending position $d_2$, bringing the cup to the vending corner 1. In process D, the cup is also present in the unit. When the cup is brought to the vending position, the horizontal cup transport unit 50 moves backward from a front position $b_1$ to a rear position $b_2$ and returns to its standby position. In process B, no cup is present in the unit. When the cup is taken up by a customer, the vertical cup transport unit 12 moves down slightly from the vending position $e_1$ to a standby position $e_2$ and stops there. When the next vending signal (v) is given, it moves down to a low position $e_3$ and returns to its initial status $e_0$. In these steps, designated by E, no cup is present. On the other hand, the cup holding unit 5 assumes: opening position $f_2$→opening position $f_3$ while the vertical cup transport unit 12 moves from a cup supporting position $d_1$ to the standby position $e_2$ through positions $d_2$ and $e_1$. It is moved from the opening position $f_3$ to a standby position $f_4$ while the vertical cup transport unit 12 is moved from the standby position $e_2$ to the low position $e_3$. Upon the vending signal (v) a cup is dropped (g), and the unit waiting for the cup receives the cup. When the unit receives the cup, it moves from a standby position $f_5$ to a holding position $f_6$, and returns to its initial position $f_0$.

In the above flow of operation, the steps A, C, and D are related to the transportation of the cup. If the cup stops at an intermediate position in the steps, the drink filled cup is disposed, and the units returns to their respective standby positions.

Because the steps B and E are not related to the transportation of the cup, the units return directly to their standby positions. Measures taken under these abnormal conditions will be discussed below.

Figure 25:
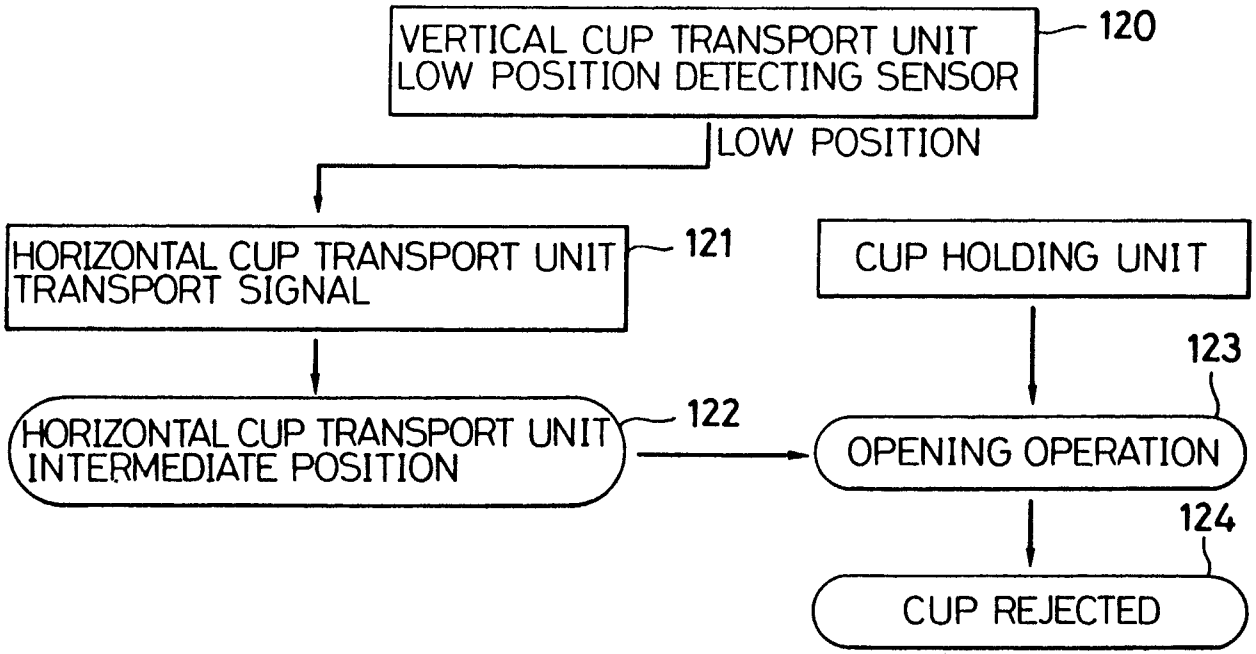
FIG. 25 shows the flow of self-returning operation of steps A of FIG. 24.

FIG. 25 is a flow chart of steps followed by the horizontal cup transport unit 50 in case abnormal stop (arising from, e.g. power failure) has occurred during the steps A.

When the stop has occurred during horizontal transportation of the drink filled cup, the vertical cup transport unit 12 remains at the low position, so that the low position detecting sensor $S_4$ will detect the unit 12 (120). Therefore, based on the detection, a move signal is given (121) to the horizontal cup transport unit 50. The horizontal cup transport unit 50 is now returned to an intermediate position (122) where it is opened (123) and disposes the cup (124), and then returns to the standby position.

Figure 26:
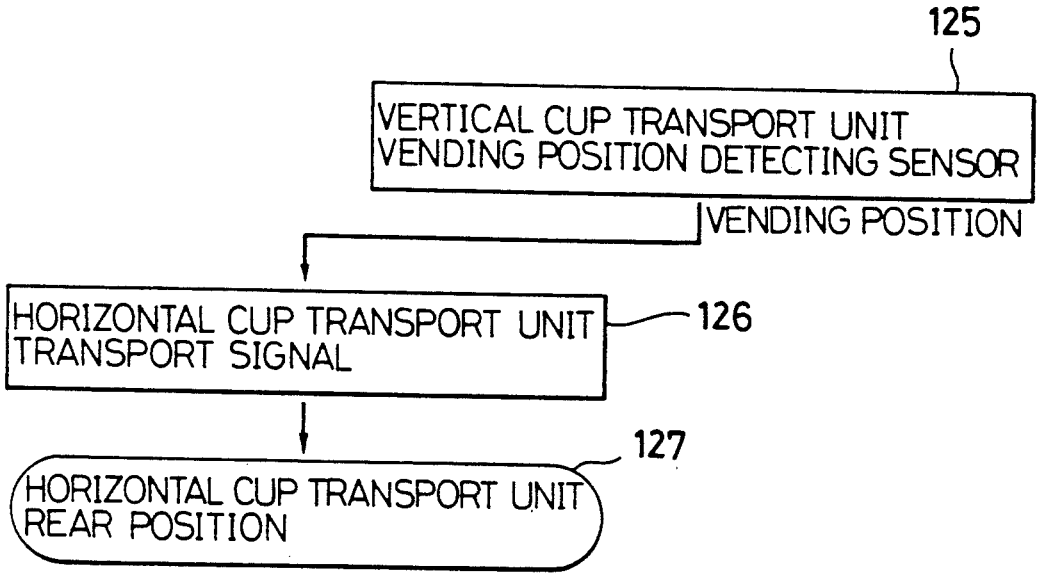
FIG. 26 shows the flow of self-returning operation of steps B of FIG. 24.

If the horizontal cup transport unit 50 stops in the step B, procedures flow as shown in FIG. 26. In this case the horizontal cup transport unit 50 is in the middle of the process to return to its standby position. Since in this case the vertical cup transport unit 12 is remaining at the vending position, the active vending position detecting sensor $S_1$ detects the unit 12 (125). Therefore, based on such detection, a move signal is given to the horizontal cup transport unit 50 (126). The horizontal cup transport unit 50 continues the backward motion and returns to the standby position (127).

Figure 27:
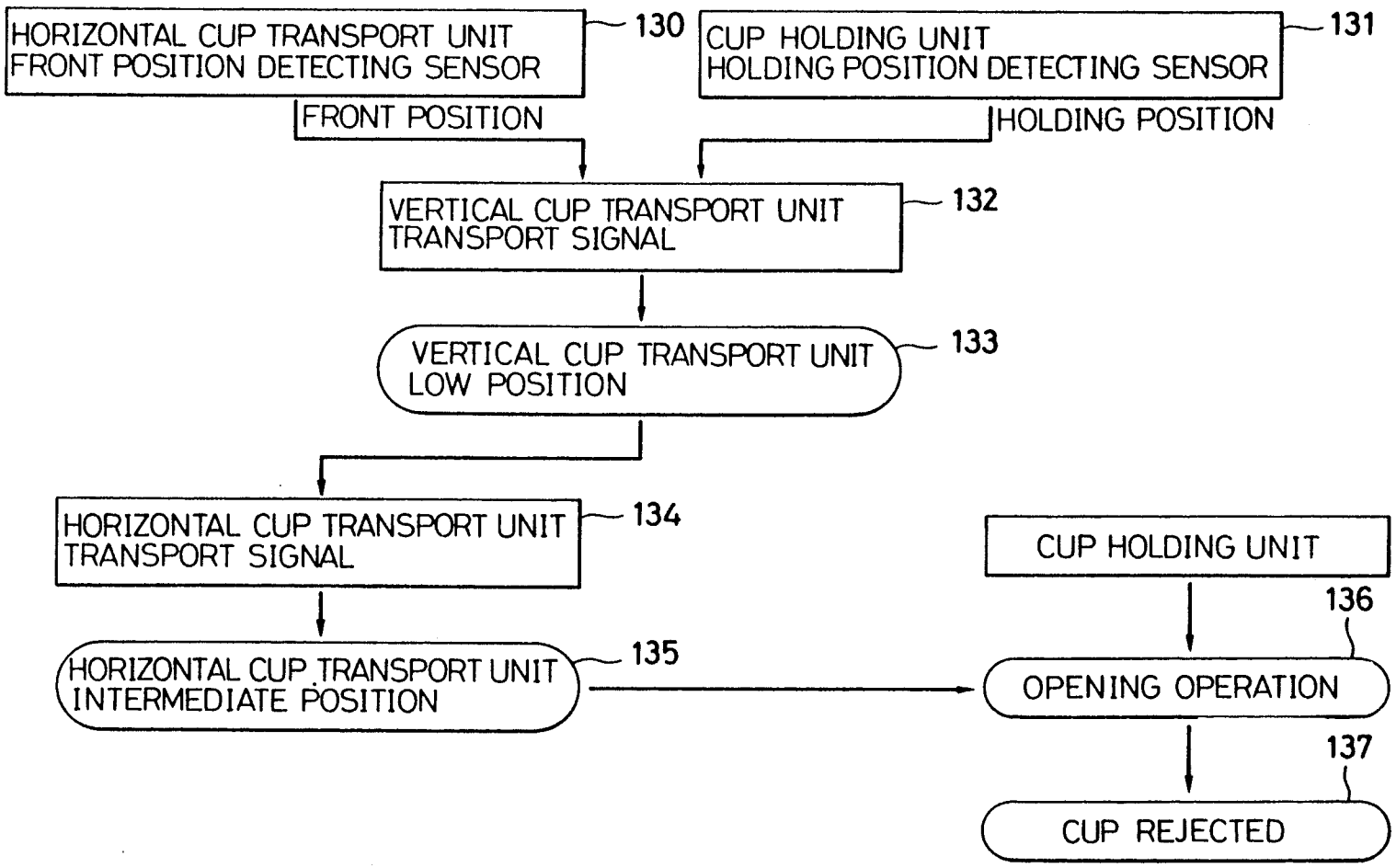
FIG. 27 shows the flow of self-returning operation of steps C of FIG. 24.

FIG. 27 shows the flow of steps followed when the vertical cup transport unit 12 is stopped in the step C.

In this case the coaster unit 18 is sopped at a position slightly moved upward to support the bottom surface of a cup. Since in this case the horizontal cup transport unit 50 is at a specified front position, the front position detecting sensor $S_3$ detects the unit 50 (130). At the same time, the holding position detecting sensor $S_9$ detects the cup holding unit sitting at the position to hold a cup (131). Based on the detection of these two sensors $S_3$ and $S_9$, a move signal is given to the vertical cup transport unit 12 (132). The vertical cup transport unit 12 is moved down to the low position and then returns to the position to support the next drink filled cup delivered there in the next vending operation (133). When the vertical cup transport unit 12 arrives at the low position, another move signal is given to the horizontal cup transport unit 50 (134). When the horizontal cup transport unit 50 moves to an intermediate position (135), the cup holding unit 5 opens (136) to free the cup for disposition (137).

Figure 28:
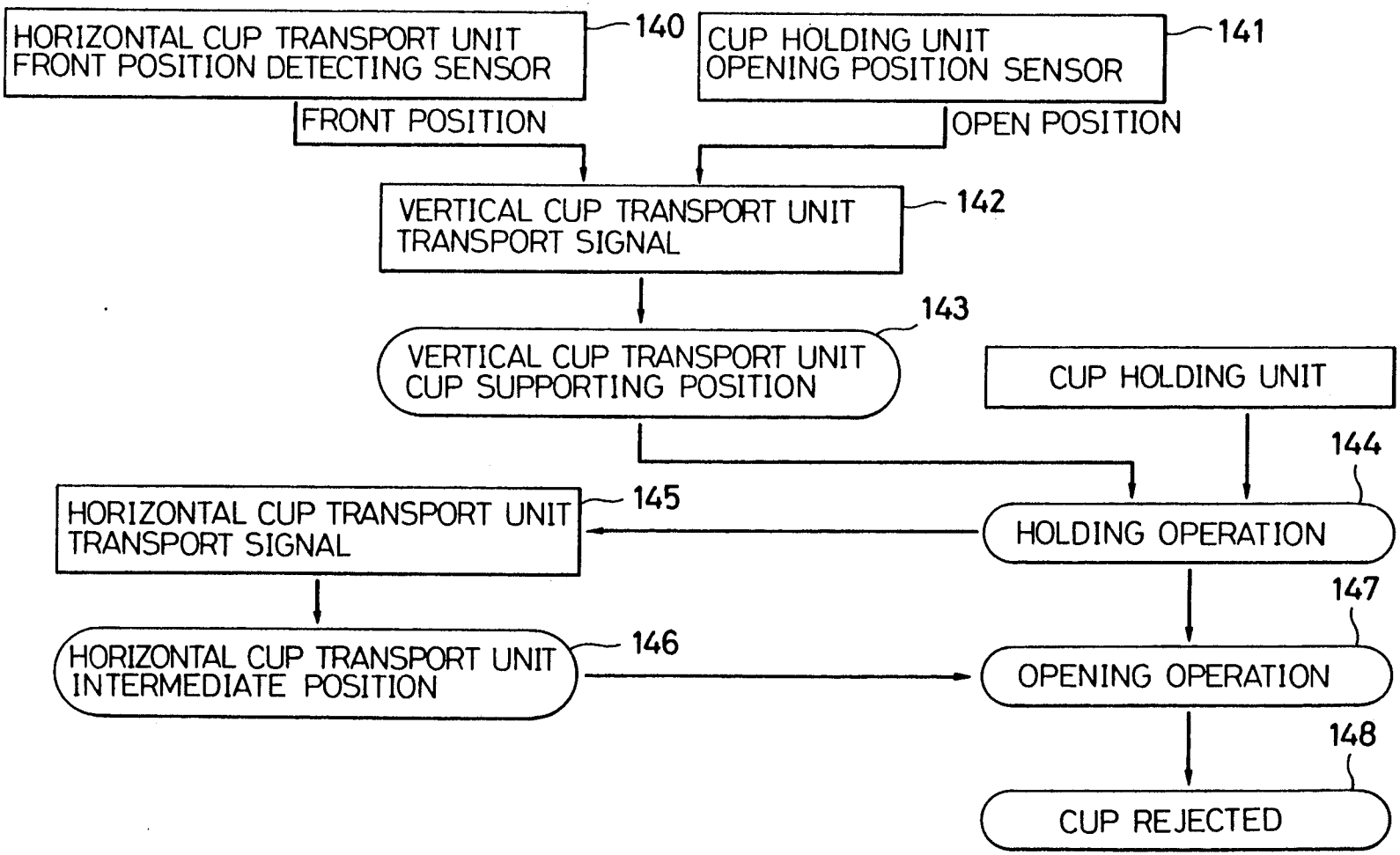
FIG. 28 shows the flow of self-returning operation of steps D of FIG. 24.

FIG. 28 shows the flow of steps to be followed when an abnormal stop has occurred during the transportation of the cup by the vertical cup transport unit 12 in the step D.

In this case, the cup holding unit 5 is opened, and the vertical cup transport unit 12 bearing thereon the coaster unit 18 is stopped midway to the vending corner 1. In this case the front position detecting sensor $S_3$ detects (140) the horizontal cup transport unit 50 sitting at the front position. The cup holding unit 5 is also opened, and the open position sensor $S_9$ detects this condition (141). Based on the detection by these two sensors $S_3$ and $S_9$, a move signal is given to the vertical cup transport unit 12 (142) which comes down to the cup supporting unit (143). The cup holding unit 5 grabs the drink filled cup (144). When the cup is grabbed, a move signal is given to the horizontal cup transport unit 50 (145), so that it moves to an intermediate position (146) where the cup holding unit 5 is opened (147), disposing the cup (148). Thereafter, the horizontal cup transport unit 50 returns to its standby position.

Figure 29:
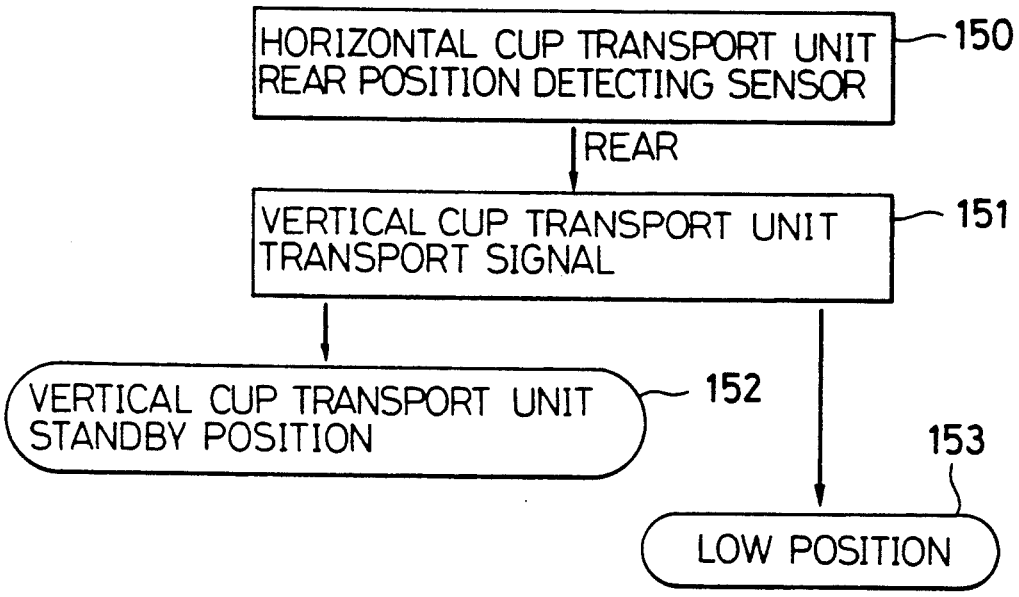
FIG. 29 shows the flow of self-returning operation of steps E of FIG. 24.

FIG. 29 shows the flow of steps to be followed when the vertical cup transport unit 12 is stopped during the vertical motion in the step E.

In this case the the horizontal cup transport unit 50 is located at a position behind the standby position since it was stopped when it was receding, based on a vending signal. The unit 50 is detected by the active rear position detecting sensor $S_1$ (150), which provides a move signal to the vertical cup transport unit 12 (151). The unit thus returns to its initial standby position (152). When next vending signal is generated, another move signal is given to the unit 12 to move it to the low position (153).

As discussed above, in case any one of the units is stopped in the middle of the steps for some reason such as power failure, a necessary action is taken (disposition of the cup) and the unit returns automatically to their standby positions.

Figure 30A:
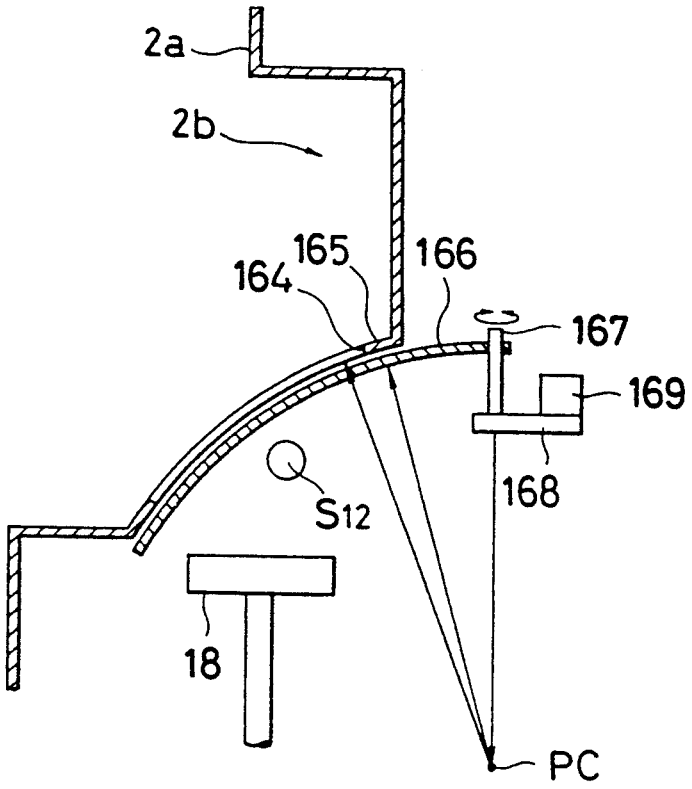
FIG. 30(A) is a schematic cross-sectional view of a peripheral mechanism of the cup outlet.
Figure 30B:
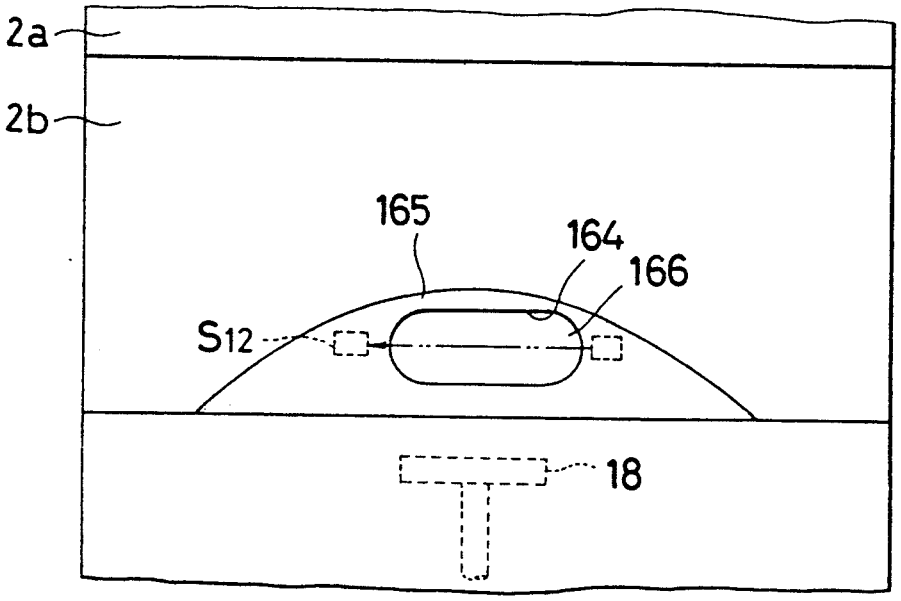
FIG. 30(B) is a partial front view of the peripheral mechanism.

The arrangement of the vending corner 1 will now be described. FIGS. 30A and B show a mechanism of a cup outlet 164.

The cup outlet 164 is formed in the central region of a cover member 165 which has a sectional spherical surface and is mounted in the recess 2*b* in the front end 2*a*. A vending door 166 is provided inside the cover member 165. The vending door 166 is a fan-shaped member having a spherical surface coaxial with the spherical surface of the cover member 165, with their spherical center at PC.

The vending door 166 is pivotally fixed on a shaft 167 which extends vertically through the center PC. The longitudinal direction of the vending door 166 coincides with the shaft 167. The shaft 167 is driven by a motor 169 via a speed reduction unit 168. Inside the vending door 166 is a cup presence detecting sensor $S_{12}$ which consists of a light emitting element and a light receiving element for detecting the presence of a cup 6. The coaster unit 18 serves to move the cup 6 from its standby position 18 (marked by a dotted line) to the cup outlet 164.

Figure 31:
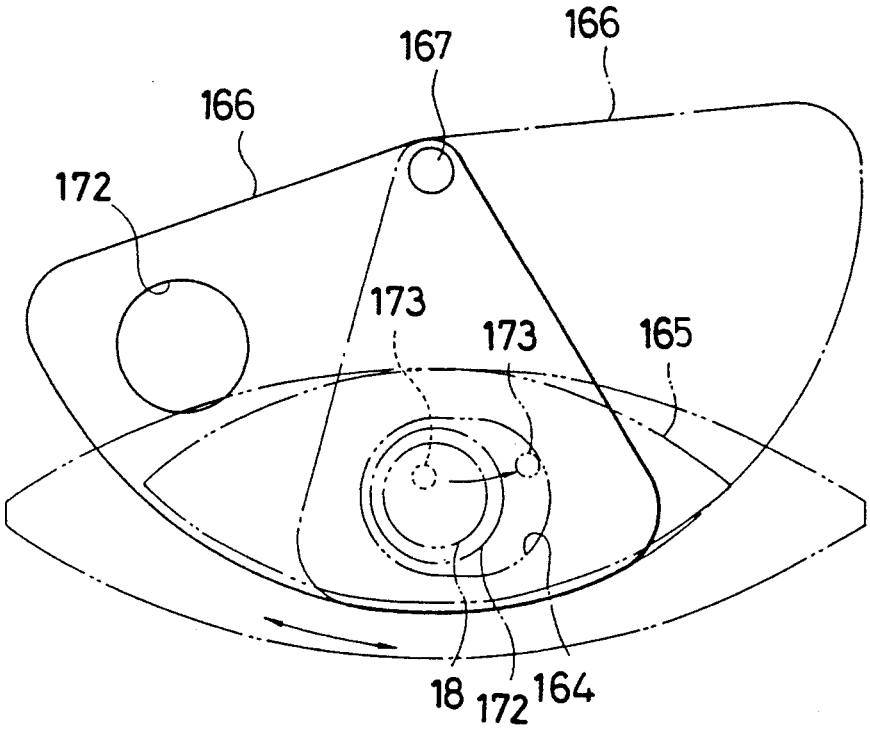
FIG. 31 is a schematic drawing of the vending door.

As shown in FIG. 31, the vending door 166 has an opening 172 which is larger in diameter than the cup 6. The cup outlet 164 is an elongate hole extending longer than the opening 172 in the moving direction of the vending door 166.

Therefore, as the motor 169 is activated, its power is transmitted to the shaft 167 through the speed reduction unit 168, and the shaft 167 is rotated in the direction defined by the rotational direction of the motor 169, so that the vending door 166 is moved in a direction appropriate to open/close the cup outlet 164.

The vending door 166 is stopped at the position shown by solid line in FIG. 31. When drink is sold, the door is rotated counterclockwise in the figure until the opening 172 comes right above the coaster unit 18.

As a result, the coaster unit 18 may come out through the opening 172 of the vending door 166 and the cup outlet 164, and the cup 6 placed on the coaster unit 18 is served to the customer.

If there is dust 173 on top of the vending door 166, it is moved by the vending door 166 to the end of the cup outlet 164, i.e. to the right end of the opening shown in the figure. It is trapped there even after the door 166 proceeds further.

Therefore, any dust 173 on the vending door 166 remains on a portion of the door 166 moved off the opening 172 so that the dust is prevented from entering into the cup 6 through the opening 172. This is possible because the size of the opening 172 is larger than the cup outlet 164 so that the dust 173 is collected on the vending door 166 outside the opening 172.

During standby period the vending door 4 closes to cover the cup outlet 164, and the coaster unit 18 is receded at the position shown in FIG. 30(A).

As explained above, the control unit start driving the motor 169 to open the vending door 166 immediately before the cup 6 is placed on the coaster unit 18, and then moves the opening 172 to the position directly above the coaster unit 18.

Figure 32A:
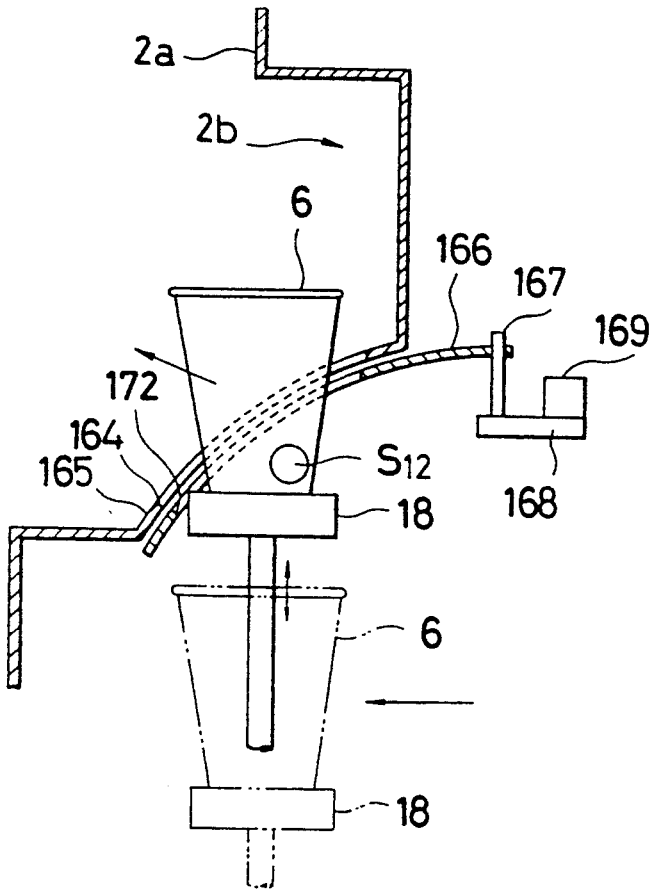
FIG. 32(A) is a schematic cross-sectional view of the cup outlet, illustrating how a cup may be taken out by a customer.
Figure 32B:
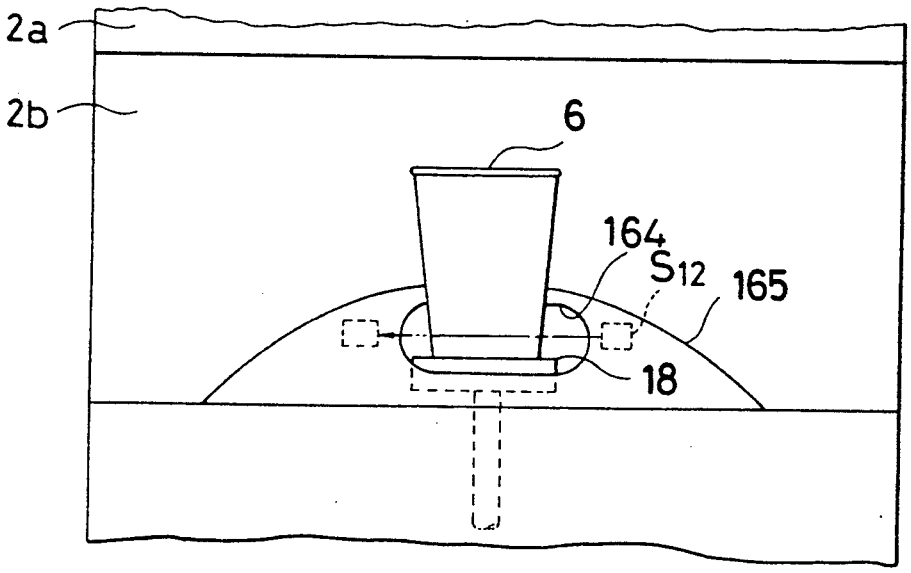
FIG. 32(B) is a partial front view of the cup outlet shown in FIG. 32(A) thereof.

When the vending door 166 has moved to open the cup outlet 164, the control unit moves the coaster unit 18 upward to bring the cup 6 extending partly out of the cup outlet 164 as shown by solid line in FIGS. 32 A and B.

The lower end of the cup 6 is now located at a level higher than the lowermost end of the cup outlet 164. Accordingly, the customer can take out the cup 6 without hitting the cup against the edge of the cup outlet 164.

When the customer takes out the cup 6, the cup presence detecting sensor $S_{12}$ no longer detects the cup 6. As the result, the control unit moves the coaster unit 18 back to the standby position. The vending door 166 is moved back to the close position to close the cup outlet 164.

In this manner, the customer can easily take out the cup 6 from the cup outlet 164.

The dimension of cup outlet 164 is elongate such that it is larger than the cup 6, and that it extends longer than the opening 172 in the moving direction of the vending door 166. This makes it possible to prevent the dust on the vending door 166 from falling in the cup 6.

The cover member 165 and the vending door 166 have coaxial spherical surfaces centered at PC. This makes it possible to reduce the gap between the cover member 165 and the vending door 166 as small as possible. Accordingly, dust is prevented from entering through this gap.

The cup presence detecting sensor $S_{12}$ is designed to detect the cup 6 inside the vending door 166, so that it will not be subject to contamination that would otherwise arise from dust, insects, and spilt beverage. Thus, the cup 6 may be properly detected by the sensor.

Although the cup outlet and the vending door are formed to have sectional spherical surfaces in the above example, they are not limited to spherical ones, so long as their surfaces have inclination towards the customer.

Also in the above example, the vending door is pivotally mounted on the vertical shaft for opening and closing the vending door. However, opening and closing mechanism for the vending door is not limited to this.

Now the mechanism of the vending door 3 will be described.

Figure 33:
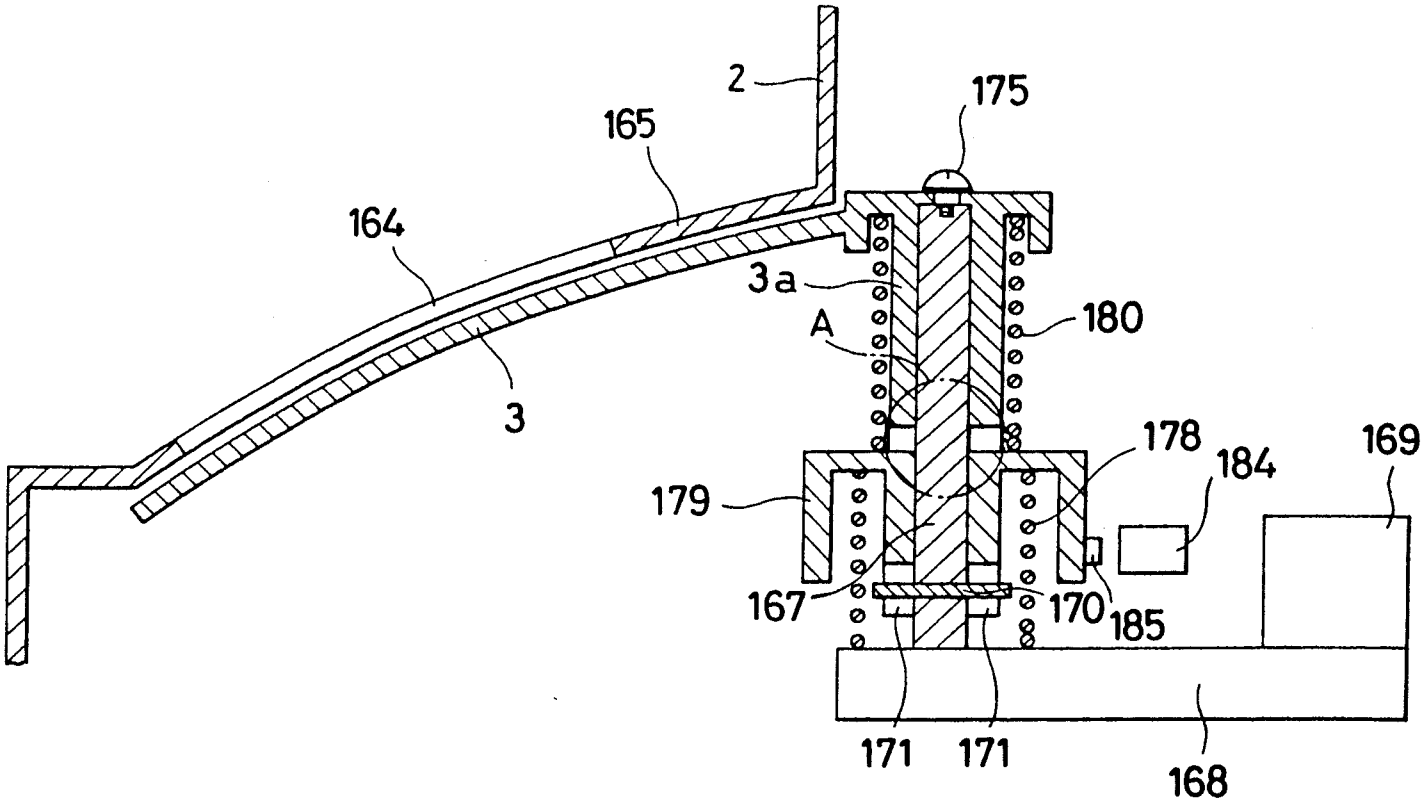
FIG. 33 is a schematic cross-sectional view, of an internal mechanism of the vending door driving unit.
Figures 35A, 35B:
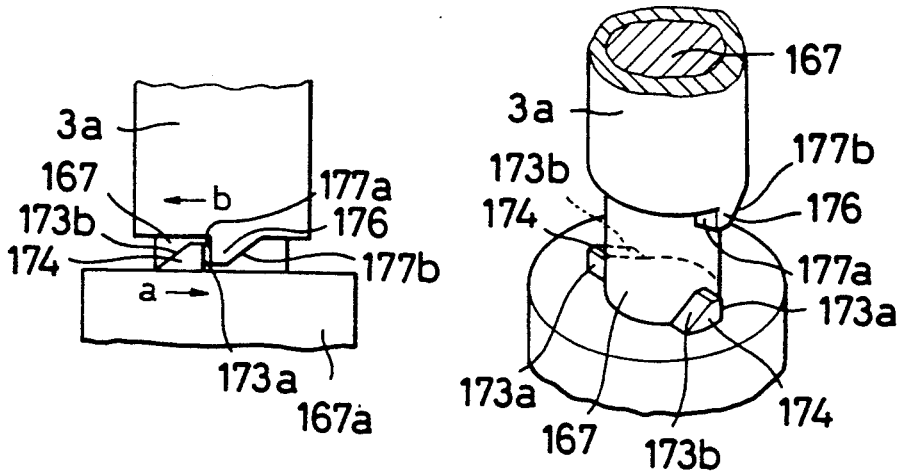
FIG. 35(A) is a detailed side view of joint portions marked by A in FIG. 33.
FIG. 35(B) is an enlarged schematic view of the joint.

As shown in FIGS. 33 and 35, the drive shaft 167 of the door 3 is operably connected with a one-way clutch 179 by means of a spring pin 170 fixedly mounted on a lower portion of the drive shaft 167 for transmitting the rotational power, and of slotted members 171 and 171 engaging with the spring pin 170. This one-way clutch 179 is engaged with the drive shaft 167 with a gap between them, which gap allows vertical motion of the clutch 179 relative to the shaft 167 over the slotted members. The spring pin 170, however, prohibits the rotational motion of the clutch relative to the shaft. Normally, the clutch is forced upwardly by the action of a spring coil 178. As shown in FIGS. 35A and B, a pair of triangular projections 174 and 174 are formed on the shaft of this one-way clutch 179. The triangular projections are angularly spaced apart by 180 degrees and located at the opposite side of the shaft. The triangular projections each have a vertical surface 173*a* on one end which is facing the direction of the action (counterclockwise: solid line arrow "a") of the one-way clutch 179 and a tapered surface 173*b* on the other end facing the non-acting direction (clockwise: dotted line arrow "b") of the clutch.

On the other hand, the base 3*a* of the vending door 3 is engaged with the top of the drive shaft 167 and rotatably supported by the pin 175 such that the base 3*a* is rotatable with respect to the drive shaft 167 but not removable from the drive shaft 167. On the lower end surface of the base 3*a* of the door, are formed triangular projections 176 and 176 similar to the projections 174 and 174, having vertical surfaces 177*a* and tapered surfaces 177*b*.

The one-way clutch 179 is forced upward and the base 3*a* of the vending door 3 is forced downward by a coil spring 178, so that the joint portions A of the one-way clutch and the base engage with each other. When the drive shaft 167 is rotated in its normal direction (counterclockwise direction) by a driving motor 169, the one-way clutch 179 mounted on the lower portion of the drive shaft is rotated together. The vertical surfaces 173*a* of the projections 174 of the one-way clutch 179 will engage the vertical surfaces 177*a* of the projections 176 of the door base 3*a*. Thus, the rotational force is transmitted from the clutch to the base 3*a* of the vending door, which in turn rotates the vending door 3 to the open position. When the circular opening 172 formed in the vending door 3 matches the cup outlet 164, a cup may be set therein.

A torsion spring 180 is provided between the base 3*a* of the vending door 3 and the one-way clutch 172. When the vending door 3 is opened, the torsion spring 180 is tightened to accumulate the torsional force, which acts on the base 3*a* in the direction to close the vending door 3.

Therefore, when the motor 169 is rotated in the reverse direction, and hence the drive shaft 167 in the clockwise direction, the vending door 3 is rotated by the torsional force of the spring 180 in the closing direction, since the vertical surfaces 177*a* of the projections 176 of the vending door 3 are engaged with the rectangular surfaces 173*a* of the projections 174 of the one-way clutch 179 under the torsional force.

Figure 34:
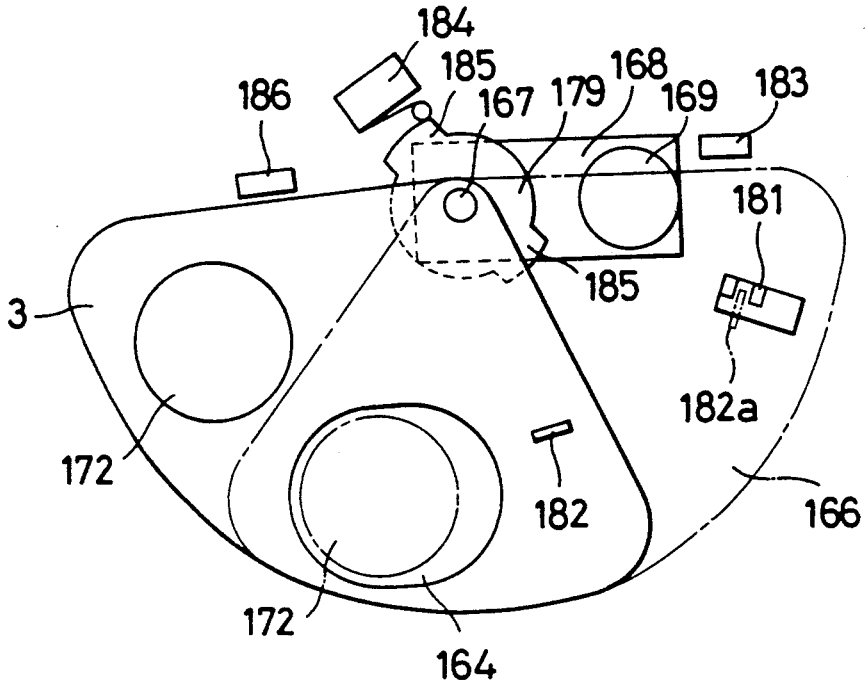
FIG. 34 is a plan view of the vending door, schematically showing the conditions for opening and closing the vending door.

A door opening detecting sensor 181 is provided for stopping the motor 169 by detecting the vending door 3 reaching the position shown by the one-dot phantom line in FIG. 34. This door opening detecting sensor 181 is an optical detecting sensor having a pair of light emitting element and a light receiving element, capable of detecting the opening of the vending door 3 when the shielding piece 182 interrupts the light impinging on a lower portion of the vending door 3 (dotted line 182*a*). A stopper 183 prevents excessive movement of the vending door 3 that may happen when the door opening detecting sensor 181 does not operate properly. A door closing detecting switch 184 is provided on the outer periphery of the one-way clutch 179 for detecting the rotational position of the drive shaft 167 at the end of closing the vending door 3. This door closing detecting switch 184 is constructed to operate on the protrusions 185 formed on the periphery of the one-way clutch 179. The motor 169 is stopped when switch is in operation (ON). A stopper 186 is provided for preventing excessive rotation of the vending door 3 in the closing direction.

The opening and closing operation of the vending door 3 will be now discussed.

I BASIC OPERATION IN NORMAL CONDITION

(1) Operation for opening the vending door 3

Figure 36:
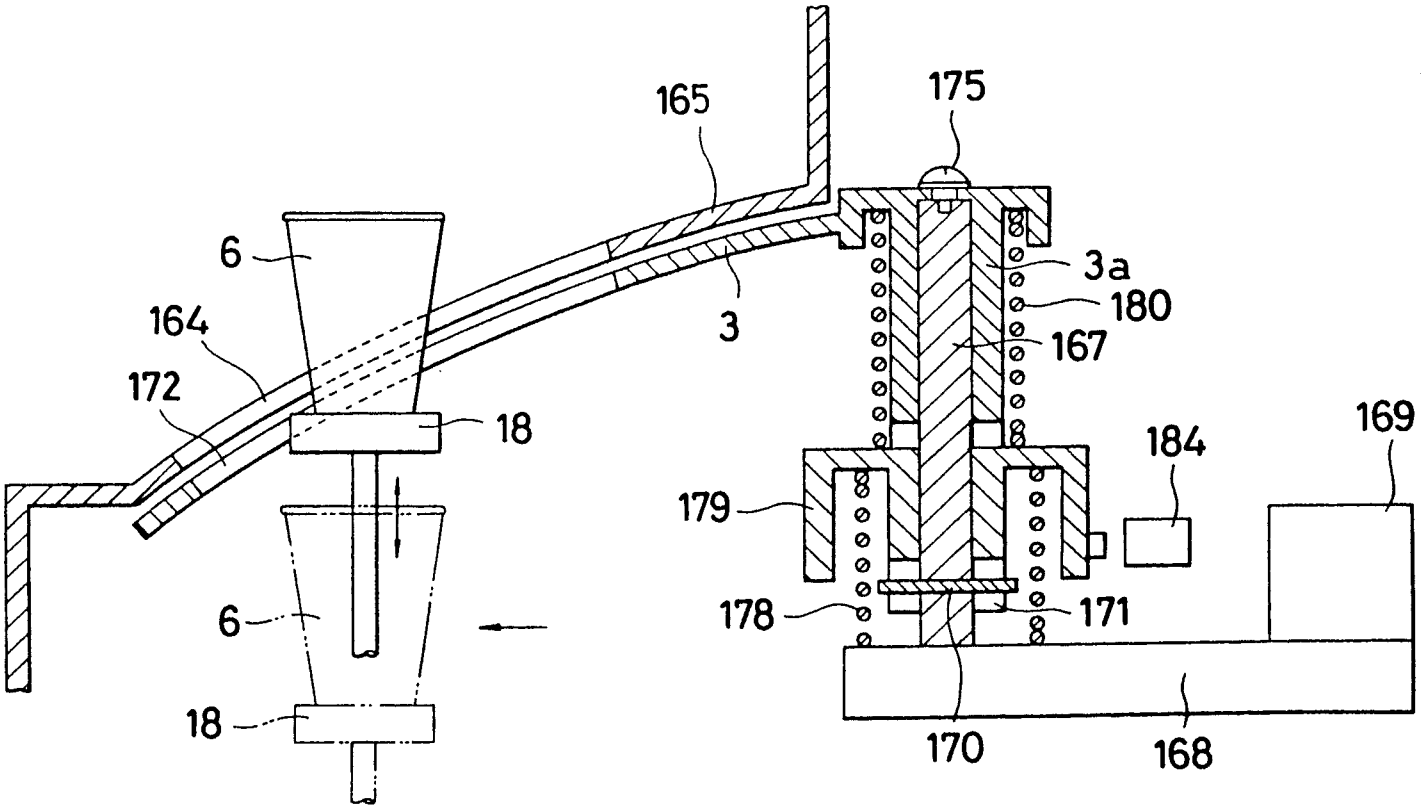
FIG. 36 is a schematic cross-sectional view of a vending door driving unit, showing its operation when the cup is taken out.

The driving power of the motor 169 is transmitted to the drive shaft 167 through the speed reduction and transmission unit 168, to rotate the shaft 167 in the counterclockwise direction. The power is transmitted to the one-way clutch 172 via the spring pin 170, rotating the clutch 172 in the counterclockwise direction. In this case, the vending door 3 is rotated counterclockwise also, since the triangular projections 174 and 176 of the one-way clutch 172 and the vending door 3, respectively, are firmly engaged with each other on the vertical surfaces 173*a* and 177*a* under the action of the coil spring 178 pushing the one-way clutch 172 upward. This rotational motion tightens the torsion spring 180, so that the spring force acting in the clockwise is accumulated. When the vending door 3 is rotated to the position shown by the one-dot phantom line in FIG. 34, the motor 169 is stopped by the detection signal emitted from the door opening detecting sensor 181. The outlet 164 of the cover member 165 and the opening 172 of the vending door 3 are now in overlapping open condition. As shown in FIG. 36, the cup placed on the coaster unit 18 is lifted from the position shown by two-dot phantom line to the position of solid line. Therefore, all that a customer has to do to get the cup is to grab the cup 6 and to take it out from the cup outlet 164.

(2) Operation for closing the vending door 3

The motor 169 is rotated in the reverse direction to rotate the drive shaft 167 in the clockwise direction. As described above, the one-way clutch 179 is also rotated in the clockwise direction. The vertical surfaces 177*a* of the projections of the vending door 3 are pushed against the vertical surfaces 173*a* of the projections of the one-way clutch 179. The vending door 3 is thus rotated in the clockwise direction.

When the vending door 3 is rotated to the position shown by solid line in FIG. 34, the motor 169 is stopped. The vending door 3 is also stopped by the detection signal from the door closing detecting switch 184. In this case, the cup outlet 4 overlies the vending door 3, so that the opening 18 is closed.

II OPERATION UNDER ABNORMAL CONDITIONS

(1) When door opening detecting sensor 181 is inoperable

Failure of the door opening detecting sensor 181 in the above operational procedure causes the vending door 3 to rotate continuously. However, the vending door 3 is stopped by the stopper 183, resulting in locking of the motor 169. A breaker unit (not shown) will respond to this lockins of the motor to cut the current to the motor 169 after a certain period of locking, thereby providing fail safe for the sensor malfunction.

In this case, the door closing detecting switch 184 is in operation in association with the rotational motion of the one-way clutch 179. Therefore, this operational condition is interpreted as a failure mode of the door opening operation.

(2) When customer's fingers are caught by the closing door 3

In this case the vending door 3 will not move further, although the motor 169 continues to rotate, until the detection signal is generated by the door closing detecting switch 184 to stop the operation of the motor 169.

That is to say, the one-way clutch 179 is stopped at an advanced clockwise position with respect to the shaft 166*a* if the vending door 3 stopped by hand. Under this condition, the projections are mutually disengaged with respect to each other.

Thus, although torsional torque of the torsion spring 180 is applied to the hand, the rotational torque of motor 169 is not transmitted to the door. Therefore, even if fingers are caught by the closing door, there is little possibility of serious injury.

If the fingers are withdrawn, the vending door 3 is rotated to the normal closing position by the torque of the torsion spring 180, and thereafter normal operation may be continued.

(3) When fingers are caught by the closing door 3 while the door closing detecting switch 184 is inoperable The vending door 3 will remain trapped by the fingers, but the motor 169 continues to rotate beyond the predetermined stopping position. When the one-way clutch 179 advances clockwise by 180 degrees relative to the shaft 166*a* of the vending door 3 stopped by the fingers, the tapered surfaces 177*b* and 174*b* of the projections 176 and 174 meet and override each other, thereby pushing down the one-way clutch 179 against the force of the coil spring 178 as the clutch continues to rotate. The tapered surfaces 177*b* and 174*b* will slip thereafter, so that the rotational torque of the motor 169 will not be transmitted to the vending door 3. Thus, it will not lead to serious injury to the fingers caught by the door, assuring safety.

After the motor 169 has been activated for a certain period of time, electric current to the motor 169 is stopped. The rotational motion of the one-way clutch 179 under the condition may be interpreted as an indication of a failure mode.

(4) When door closing detection switch 184 is inoperable

The vending door 3 is unable to move by the action of the stopper 186. The operation thereafter is the same as described in (2)–(3) above.

The door 3 may be rotated in the clockwise direction under the torsional force of the spring 180, by disengaging the vending door 3 from the one-way clutch 179 by removing the stopper 186 and by pushing the one-way clutch 179 down. The vending door 3 may be then moved behind the cover member 165. (This is convenient in cleaning the inner surface of the cover member 165 and the upper surface of the vending door 3.)

It is desirable to make the opening timing of the vending door 3 variable with respect to the lifting timing of the cup 6, as described below.

A reason for this is that it is desirable to bring the cup 6 to the position (Cup 3) beneath the vending door 3 only after the vending door 3 is completely open. Then, since the dust on the vending door 3 has fallen already by the time the cup reaches the position, it does not fall into the cup 6.

Therefore, the vending door 3 should start its opening operation soon after the cup begins to move from the drink injection position, and complete the operation before the cup reaches the position.

However, customers may feel uneasy if they should wait for the cup for a long time after the vending door 3 has opened, since it takes a long time to lift the cup 6 to the vending corner. This timing is preferable, though, if the machines are installed at places where cleaning of the dust on the vending door 3 is difficult.

On the other hand, if the lifting of the cup is so timed to begin immediately after the opening of the vending door 3, customers will not worry about the delay. This timing is suitable for machines set up in clean rooms or places where there is no need to worry about the dust intrusion into the cup.

In this way, in order to provide satisfactory service to the customers, the timing should be variable and set according to the conditions of the location of the vending machine installed. Locations include, for example, a location for a fixed group of customers and a location for general customers.

For this purpose, the opening of the vending door 3 may be controlled by a timer. For example, the starting time of the door opening operation may be set such that the operation begins after a predetermined period of time following the beginning of cup transportation. It is also possible to set the timer so as to start the operation after completion of the cup transportation. This may be accomplished by providing a position detecting sensor arranged at some reference point in the cup transportation route, for detecting an arriving cup to initiate the opening of the vending door 3.

Another approach to control the door opening operation is to establish timing between the door motion and the cup position, Typical timing includes:

(1) To start opening operation when cup movement is started;

(2) To start opening operation when the cup has come to a predetermined intermediate position;

(3) To start opening operation when the cup reaches an intermediate position of the vertical cup transport unit.

In order to set such timing mentioned above for the vending door 3, a door opening-closing detecting switch $S_{11}$ (sensor) is provided on the vending door 3, along with the position detecting sensors $S_1$, $S_2$ and $S_3$ provided at the standby position, the intermediate stop position, and the front stop position, respectively, of the horizontal cup transport unit 50 and the position detecting sensors $S_4$, $S_5$, and $S_6$ provided at the standby position, the low position, and an intermediate position, respectively, of the vertical cup transport unit 12, and a sensor $S_7$ at the vending position.

Figure 37:
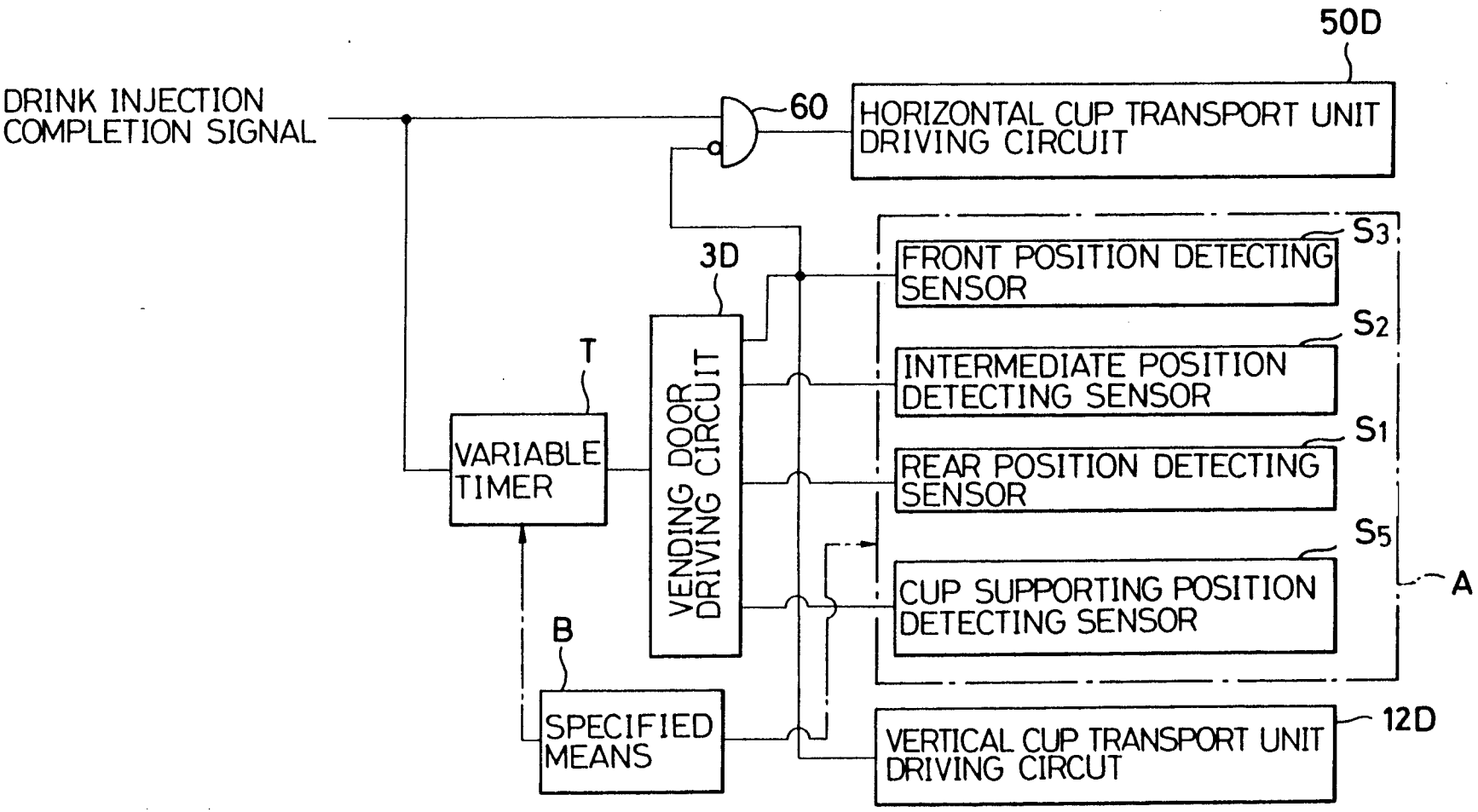
FIG. 37 is a block diagram of a control circuit having a timer system and a timing system for use in setting the starting time of the opening operation of the vending door.

FIG. 37 shows a block diagram of a control circuit for switchably controlling both timer setting and timing setting systems using these sensors by selecting one of the systems by a setting means.

In this figure, given a drink injection completion signal, a variable timer T outputs, after predetermined time, a signal to initiate the operation of vending door driving circuit 3D. This establish a door opening operation time.

This vending door driving circuit 3D receives detection signals from the front position detecting sensor $S_3$, the intermediate position detecting sensor $S_2$, the rear (standby) position detecting sensor $S_1$, and the cup supporting (intermediate) position sensor $S_5$. Which of these signals is to be used in driving the vending door driving circuit (3D) depends on a decision made in advance by the setting means. The vending door driving circuit 3D is started by the signal transmitted from the selected one of the sensors $S_1$ to $S_5$ indicating the arrival of the cup at that position, and accordingly the door opening operation is started. The horizontal cup transport unit driving circuit 50D is connected to the front position detecting sensor $S_3$ which outputs a signal indicative of the absence of the cup at that position. The circuit is activated through a logic circuit 60 only when a signal indicative of the completion of drink injection is received. Accordingly, only the cup transport operation proceeds after the completion of drink injection and until the arrival of the cup at the front position. The detection signal from the front position detecting sensor $S_3$ is also given to the vertical cup transport unit driving circuit 12D. When the cup comes to the front position, the vertical cup transport unit 12 starts its operation to slightly lift the coaster unit 18 to the cup supporting position (the intermediate position).

Therefore, it is possible to perform timing setting based on the selected positions of the cup suitable for opening the vending door 3 at desired time, by selecting the sensors from the sensors $S_1$, $S_2$, $S_3$ and $S_5$ accordingly. The entire timing setting system is shown by Frame A indicated by a one-dot line. In the figure, specifying means B is provided for selecting either the variable timer T, which is a timer-type setting means, or the timing-type setting means A.

Figure 38:
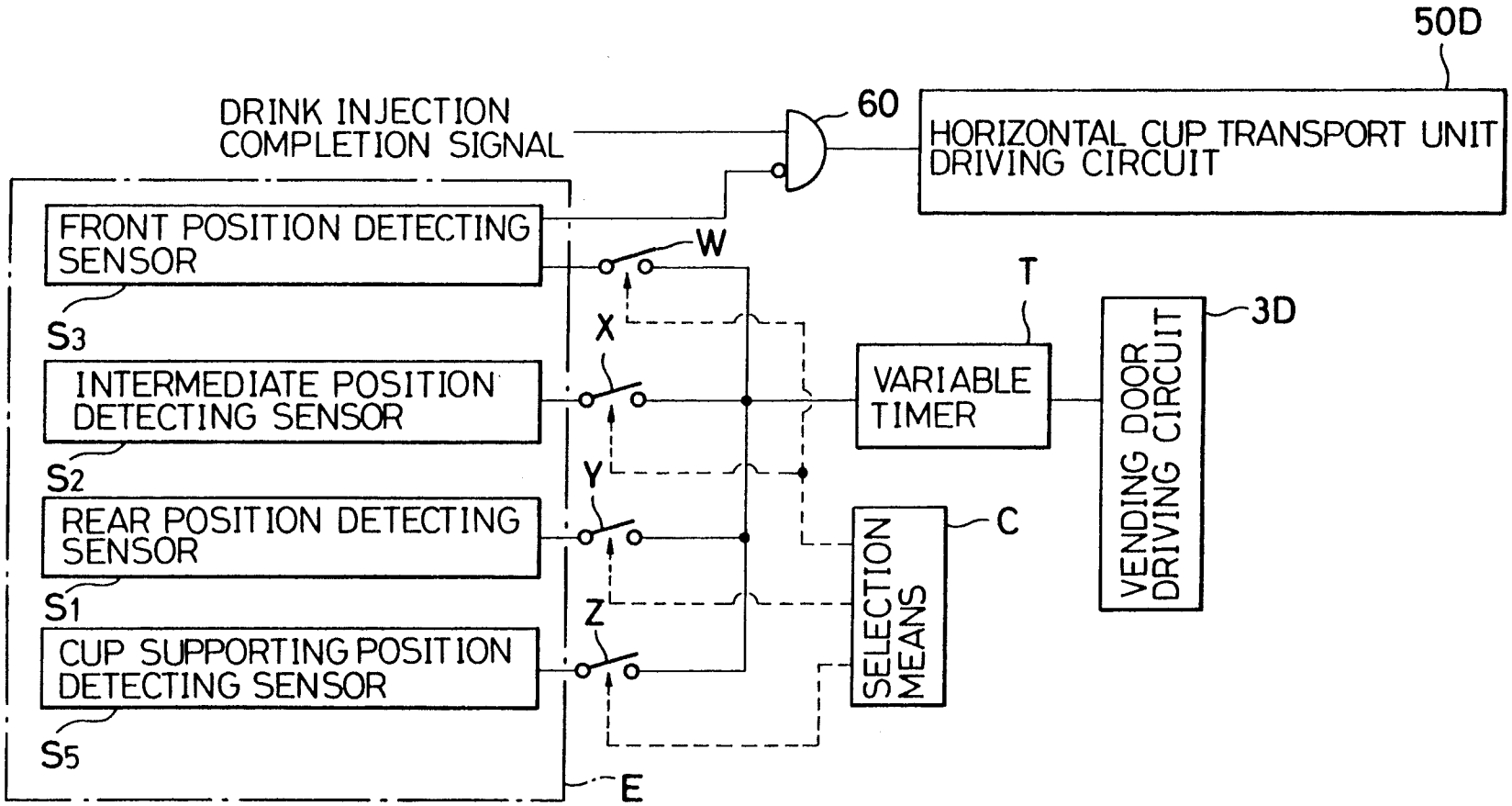
FIG. 38 is a block diagram of a control circuit for controlling the operation of the vending door after a predetermined time subsequent to the arrival of the cup at a predetermined position.
Figure 39:
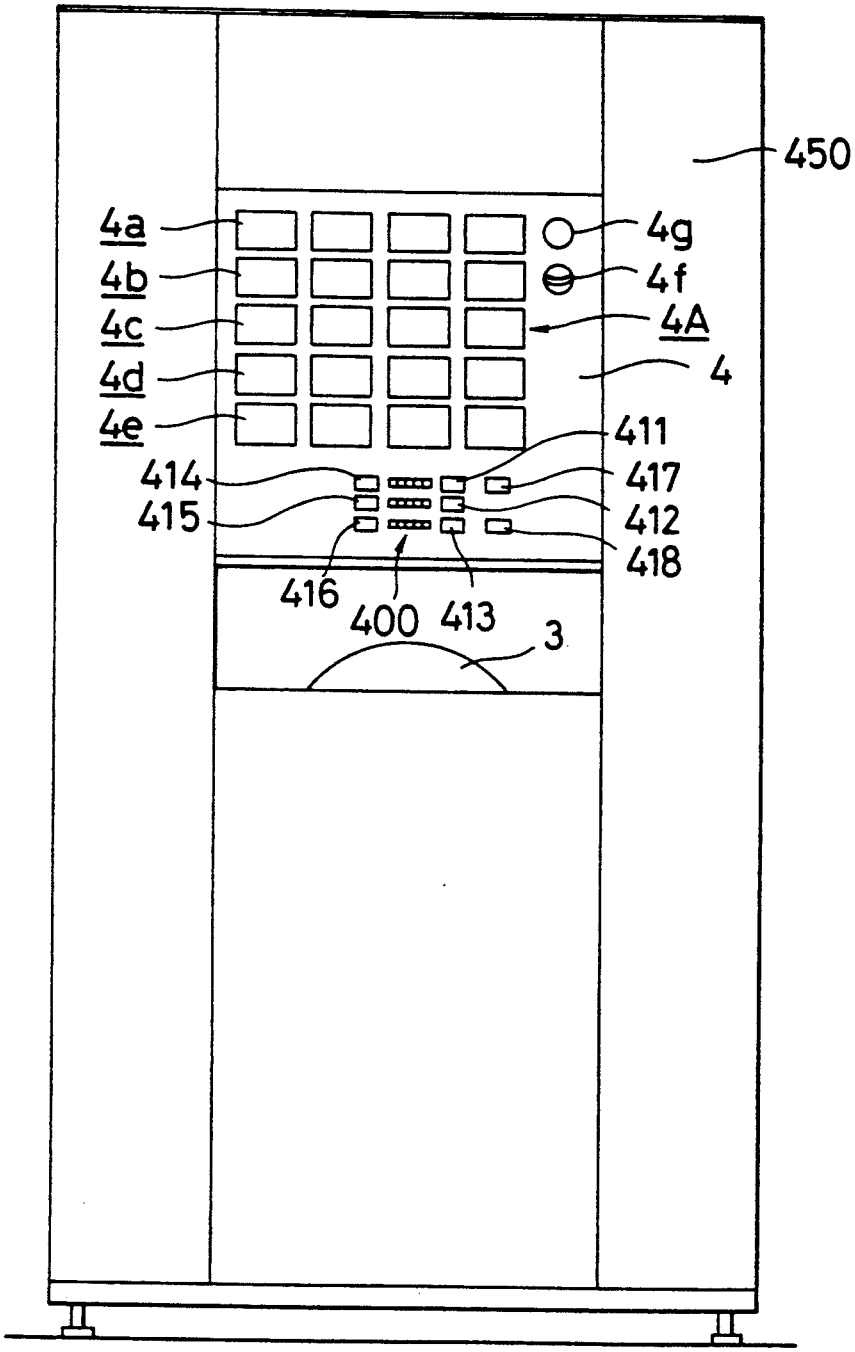
FIG. 39 is a front view of the cup type automatic vending machine.

FIG. 38 shows a control block diagram illustrating time setting by the timer system, wherein the vending door is set to open at a predetermined time after the cup arrived at a specified reference position in the route.

The above reference position may be any of the positions of the sensors $S_1$, $S_2$, $S_3$ and $S_5$ (rear, intermediate, front and cup supporting positions, respectively). Block E shown by a one-dotted line serves as an input means to the timer T. The detecting signals output from the sensors $S_1$, $S_2$, $S_3$ and $S_5$ are selectively input to the variable timer T via switches X, Y, Z, and W of a selection unit C. Accordingly, receiving a detection signal from the selected sensor, the variable timer T is activated. That is, when the cup arrives at the predetermined reference position, the variable timer T is activated to drive the vending door driving circuit 3D after a predetermined time.

The arrangement and the functions of control buttons on the control panel of this automatic vending machine will be described below.

The main unit 450 of the vending machine has a control panel 4 at an upper center of the front surface. The control panel 4 is provided with regular arrays of various buttons for selecting various types of drinks. A coin slot **4*f* and a refund button 4*g* are arranged adjacent the bottoms. This model shown in the figure is designed to provide carbonated drinks flavored with syrups and coffee drinks. Selection buttons 4*a* are provided for the carbonated drinks and selection buttons 4*b* to 4*e* are for coffee drinks. These selection buttons for coffee drinks include the selection button 4*b* for the coffee with sugar and cream, the selection button 4*c* for coffee with sugar, the selection button 4*d* for coffee with cream, and the selection button 4*e* for black coffee. When one of these selection buttons, except 4*e***, is pressed, the machine will provide regular coffee blended with sugar and milk at a specified ratio.

Figure 40:
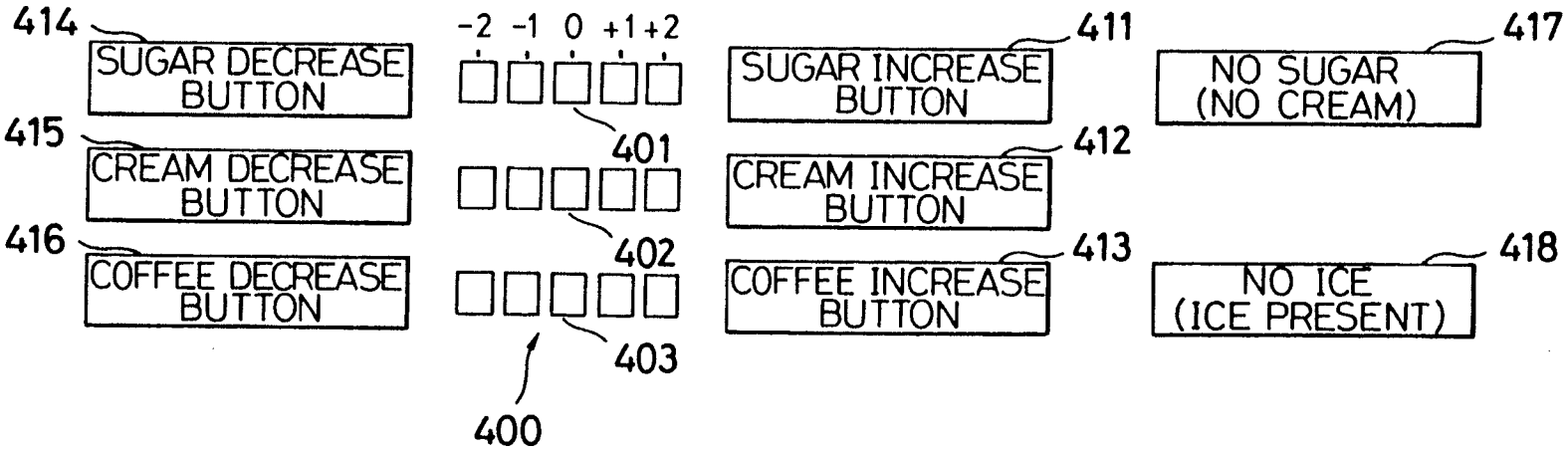
FIG. 40 shows the detailed arrangement of increase/-decrease buttons and associated increase/decrease indicator lamps.

There are also provided increase buttons and decrease buttons to change the amounts of sugar, cream and coffee material bit by bit in several steps. A set of increase/decrease indicator lamps 400 is also provided below the selection buttons 4A, which are lighted one at a time in correspondence with the selection of the increase/decrease buttons. The detailed arrangement of the buttons and the lamps is shown in FIG. 40. As seen in the figure, five-indicator lamps 401, 402, and 403 are aligned horizontally one for each flavor material (i.e. sugar, cream and coffee (in powder form)), so that the customers can tell at a glance how much that flavor material is increased or decreased with respect to the regular coffee. To the right of the indicator lamps a sugar increase button 411, a cream increase button 412, and a coffee increase button 413 are arranged. Similarly, to the left of the indicator lamps are a sugar decrease button 414, a cream decrease button 415 and a coffee decrease button 416.

The increase/decrease indicator lamps and the increase/decrease button are related in such a way that when one of the increase buttons 411, 412 and 413 is pressed, lighting shifts to the right by one step (lamp). When one of the decrease buttons 414, 415 and 416 is pressed once, the lighting shifts to the left by one step. The lamps are lit only when a customer deposited coin in the slot, at which time lamps at position 0 are lit (corresponding to regular coffee). If the increase/decrease button is pressed once, the lighting shifts to the position $+1/-1$. If the same button is pressed once more, it is shifted to the position $+2/-2$. A button 417 is provided for coffee without sugar or cream. If this button is pressed immediately after pressing a button for coffee with sugar, coffee is provided without sugar. If it is pressed after pressing for coffee with cream, coffee is provided without sugar and cream. A button 418 is provided for coffee with ice: if it is pressed, no ice is provided.

FIG. 41 shows possible combinations of the selections of these increase/decrease buttons made for coffee with sugar and milk. During a period waiting for a customer, the increase/decrease indicator lamp 400 are not lit, as shown in FIG. (1). After a specified amount of coins is inserted, the increase/decrease indicator lamps 400 at position 0 (regular) are lit, as shown in FIG. (2). If the decrease button 414 is pressed once, the corresponding increase/decrease indicator lamp 401 at the position of $-1$ is lit, as shown in FIG. (3). If the cream button **4*b* is pressed, an amount of sugar to be added in the coffee is decreased by the amount equivalent to one push of the sugar button 414. Therefore, If the decrease button 414 is pressed once more, as indicated in FIG. (4) and if the selection button 4*b* (for coffee with cream) is pressed thereafter, the quantity of sugar to be decreased is doubled. When the increase button 411 is pressed once under the condition (4), the selection will be changed to the condition as shown in FIG. (5). if the increase button 411 is pressed once more, the condition returns to the regular condition, FIG. (6). If the increase button 411 is pressed again once or twice, the corresponding conditions of the increase/decrease indicator lamps 401 will become as shown in the FIGS. (7) or (8**), respectively. Thus, the quantity of sugar may be increased or decreased step by step with respect to the regular coffee in unit of a given amount (which a mount corresponds to a+ or a−). This unit may be adjusted as desired. Similarly, the relative amount of cream and coffee materila may be increased/decreased by selecting one of the increase/decrease buttons.

Figure 42:
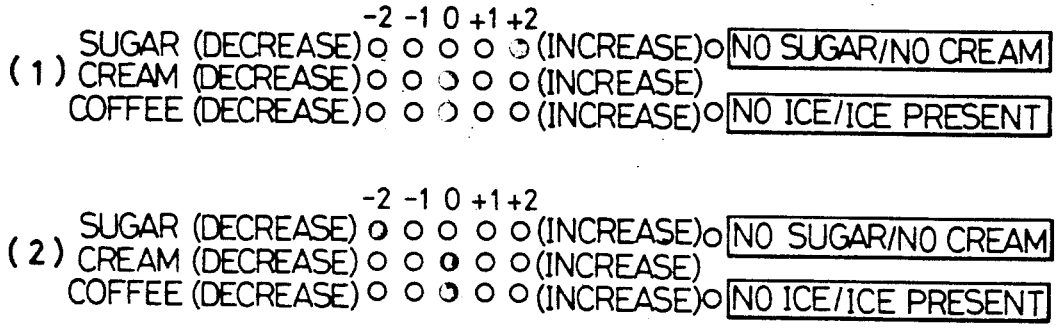
FIG. 42 shows the change in increase/decrease indicator lamps indication when a selection is made for black coffee.

FIG. 42 shows the case where black coffee is selected. In this case also, if the customer changes his mind to add sugar to black coffee after he has selected the selection button 4e for black coffee, he may push the increase button 411 for that purpose. If a plus (+) indication appears, sugar is added by that amount. This condition is shown in the upper FIG. (1).

On the other hand, if the decrease button 414 is pressed, a minus (−) sign will appear as shown in lower FIG. (2), but no sugar is added.

The increase/decrease buttons for cream 412 and 414 functions similarly as in the case of sugar button. Accordingly, it is possible to meet the demands of the customers satisfactorily.

It is noted that the selection made by the increase/decrease buttons for sugar and cream is superseded by the selection made by the no-sugar/no-cream button 417. An example for this is shown in FIG. 43.

Figure 43:
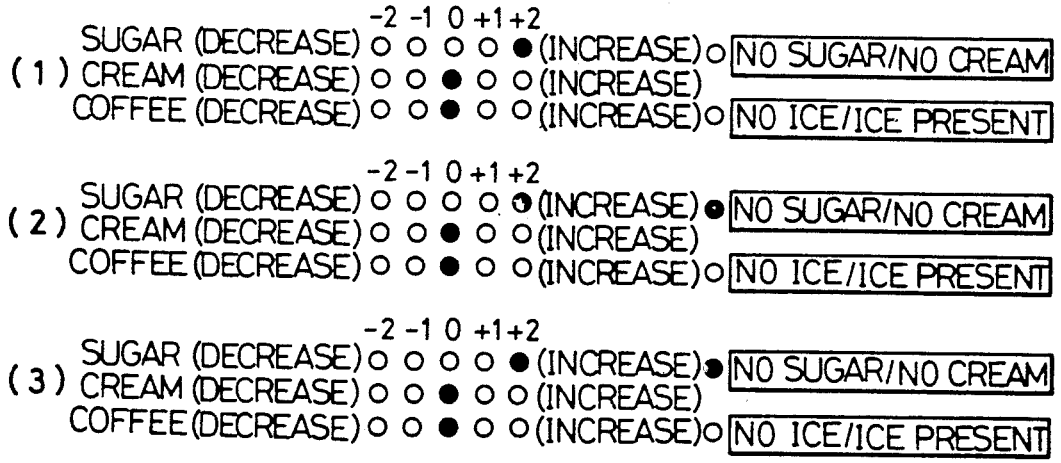
FIG. 43 shows the change in increase/decrease indicator lamps when the no-sugar/no-cream button is pressed after the increase/decrease button was pressed.

The condition shown in FIG. 43 (1) represents the selection of coffee with sugar and cream with sugar increased by two units (+2). The selection is made by pushing the button 411 twice. If in this case the customer changes his mind to get sugarless coffee, and pushes the no-sugar/no-cream button 417, the indication will change to one as shown in FIG. (2). The sugar indication is still plus (+) 2. However, since the selection made by the no-sugar/no-cream button 417 supersedes the selection made by button 411, no sugar will be added.

Similarly, if the no-sugar/no-cream button 417 is pressed after pushing the sugar increase button 411 twice following the selection of coffee with sugar and cream, the selection by the button 417 supersedes the previous selection by the button 411, so that no sugar is added, although the indication is plus (+) 2. This condition is shown in FIG. (3).

Figure 44:
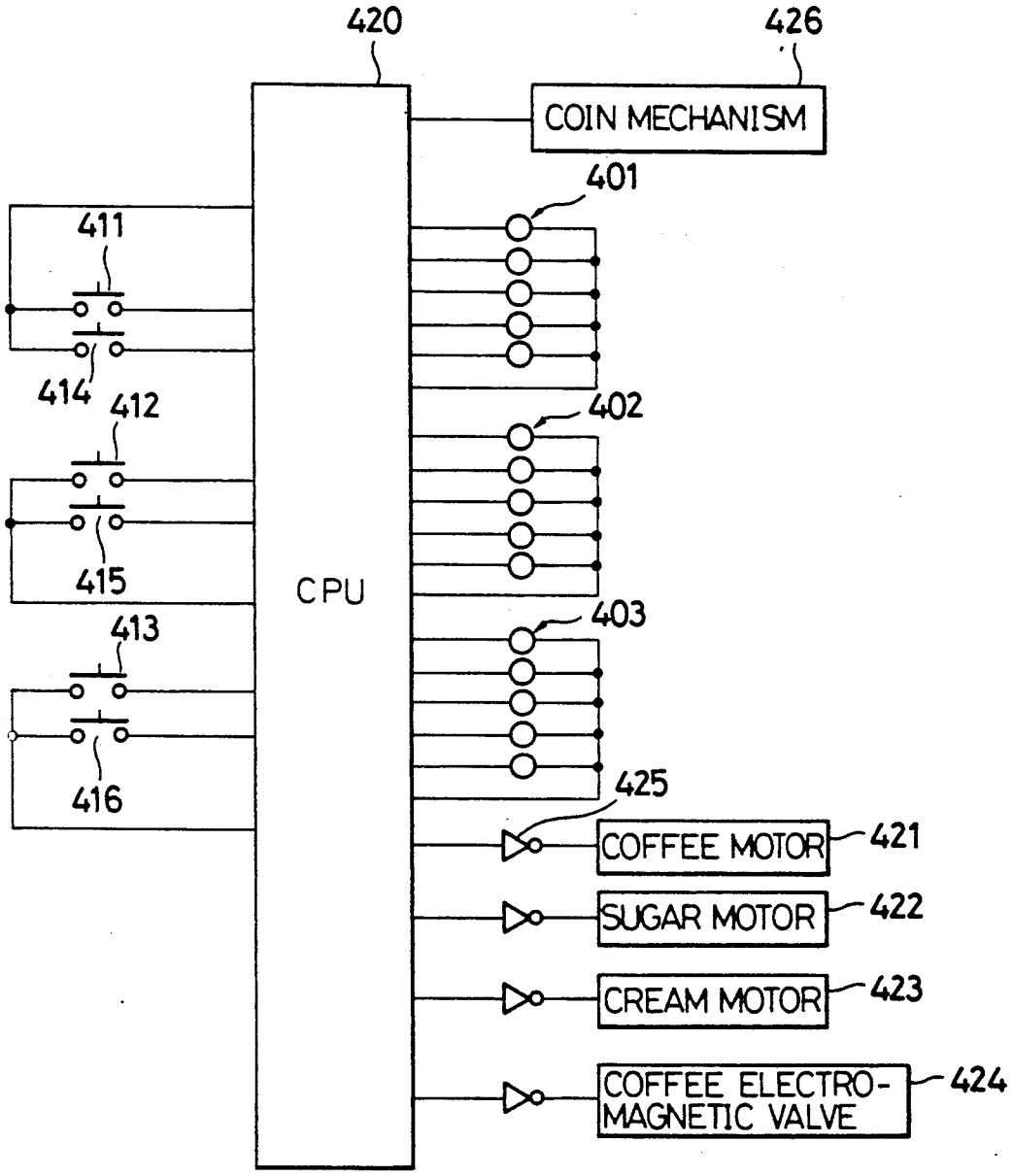
FIG. 44 shows a diagram of the control circuit.

FIG. 44 shows a control circuit for the increase/decrease indicator lamps and related driving mechanisms described above. A microcomputer 420 controls the order and types of the selections made by pushing corresponding selection buttons 411, 412, 413, 415 and 416, and controls lighting conditions of increase/decrease indicator lamps 401, 402 and 403 accordingly, each time one of the increase/decrease buttons for sugar, cream and coffee is selected. The microcomputer 420 also provide, through an inverter 422, signals for controlling the operations of a coffee motor 421, a sugar motor 422, a cream motor 423 and a coffee electromagnetic valve 424. A coin mechanism 426 is provided for counting coins deposited by a customer and for calculating change under the control of the microcomputer 420.

We claim:

1. A cup type automatic vending machine for offering a drink injected in a cup in the machine at the start of a vending operation, comprising:
- an outlet in the front portion of said vending machine;
- a vending door for opening and closing said outlet;
- a cup transport means for transporting said cup from the position in the machine of injecting a drink to said outlet, and for extending the cup from said outlet; and
- cup rejection means at an intermediate position of said cup transport means for rejecting a drink filled cup which does not satisfy certain predetermined conditions.

2. A cup type automatic vending machine according to claim 1, further comprising:
- means for detecting a cup left over in the cup transport means during power failure, after power is recovered;
- means for transporting a cup detected by said detecting means by operating said cup transport means to said cup rejection means; and
- means for returning said cup transport means to its position where drink is injected in a cup if said detection means detects no cup in the cup transport means.

3. A cup type automatic vending machine according to claim 1, further comprising cup supplying means, means for holding a cup released from said cup supplying means and for moving said cup to the drink injection position.

4. A cup type automatic vending machine according to claim 1, further comprising:
- cup supplying means; means for holding a cup released from said cup supplying means;
- means for detecting the presence of a cup in said cup holding unit; and
- means for judging if a cup is trapped according to the detecting operation of said cup presence detecting means.

5. A cup type automatic vending machine according to claim 1, further comprising:
- cup supplying means;
- means including a pair of opening/closing type cyp grabbers for holding a cup released and dropped from said cyp supplying unit;
- means for detecting if the cup is misplaced in said pair of grabbers of said cup holding means; and
- means for controlling the opening/closing operation of said pair of cup grabbers when a misplaced cup is detected by said misplaced cup detecting means.

6. A cup type automatic vending machine for offering drinks injected in a cup released by the onset of a vending operation, comprising:
- cup supplying means for releasing a cup;
- cup holding means for holding the cup released and dropped from said cup supplying means;
- front-rear cup transport means for transporting said cup holding means in an approximately horizontal direction;
- a counter table at the front of said machine;
- vertical cup transport means for receiving and holding the cup transferred from said front-rear cup transport means and for upwardly transporting said cup to said counter table; and
- an open/close type cup outlet adjacent said counter table, for allowing, when it is opened, said cup lifted by said vertical cup transport means to extend from said outlet.

7. A cup type automatic vending machine according to claim 6, further comprising:
- a vending door for opening and closing said outlet;
- detecting means for detecting the opening and closing conditions of said vending door; and
- control means for allowing said cup holding means to transfer the cup to said vertical cup transport means under the condition that said detecting means detected the vending door open.

8. A cup type automatic vending machine according to claim 6, further comprising:
- cup presence detecting means for detecting the presence of a cup at said cup outlet;
- means for receiving money to allow selection of a drink to be vended;

memory means for permitting selecting drinks and storing information of the selection;

detection means for detecting if a cup has been removed from said cup outlet; and means for starting vending operation of a selected drink previously stored in memory when the cup presence detecting means detects that a cup is not present in the cup outlet upon a cup filled with drink being removed from the outlet.

9. A cup type automatic vending machine according to claim 6, further comprising:

cup presence detection means for detecting the presence of a cup at said cup outlet;

means for returning said cup holding means to a position to receive a cup from said cup supplying means provided that the cup holding means has transferred the cup to said vertical cup transport means;

means for releasing and dropping a cup for the next vending operation;

means for injecting said selected drink into said cup held by said cup holding means; and said vertical cup transport means under the condition that said cup presence detection means detects no cup in said cup outlet.

10. A cup type automatic vending machine according to claim 6, further comprising:

a cup chute for guiding said cup released from said cup supplying means;

cup detection means for detecting if a cup is trapped in said cup chute; and means for injecting gas into said cup chute to remove a trapped cup if a trapped cup is detected by said cup detection means.

11. A cup type automatic vending machine according to claim 6, further comprising:

a cup outlet provided at said counter table with its opening larger than the diameter of a cup;

a vending door for opening and closing said cup outlet;

driving means for opening and closing said vending door by moving said vending door in the opening direction for a distance greater than the size of the outlet opening covered by said vending door.

12. A cup type automatic vending machine according to claim 6, further comprising:

a vending door for opening and closing said cup outlet;

driving means for opening and closing said vending door;

cup presence detection means for detecting the lower end of a cup which has been lifted to said counter table by said vertical cup transport means with its upper portion extending from said cup outlet, wherein:

said counter table has a surface inclined towards a customer using the machine; and said cup outlet is formed in said inclined surface; and said vending door is formed in a shape corresponding to that of the inclined surface.

13. A cup type automatic vending machine according to claim 6, further comprising:

a vending door for opening and closing said outlet;

timer means that starts counting time at the completion of injecting drink in said cup;

detection means for detecting if the cup has been transported to a predetermined position in the cup transport means; and control means for controlling opening of said vending door after a predetermined time counted by said timer or after said detecting means has detected a cup at said position.

14. A cup type automatic vending machine according to claim 6, further comprising:

a rotatable vending door for opening and closing said outlet;

a motor;

a drive shaft driven by said motor;

a one-way clutch mounted on said shaft for transmitting power for driving said vending door when it is rotated in a first direction; and a spring member that exerts an elastic spring force in the direction of closing said vending door.

15. A cup type automatic vending machine for offering drinks injected in a cup released from a cup supplying unit by the onset of a vending operation, comprising:

a counter table at a portion of said machine;

a cup outlet adjacent said counter table;

a vending door for opening and closing said outlet;

a cup transport means for transporting said cup from the position of injecting the drinks in said main unit to said outlet, and for extending the cup from said outlet, said transporting means comprising:

a cup supplying unit for releasing and dropping a cup;

a cup holding unit for holding said cup released and dropped from said cup supplying unit;

a front-rear cup transport means for transporting said cup holding unit in an approximately horizontal direction;

a vertical cup transport unit for receiving and holding the cup transferred from said front-rear cup transport means and for upwardly transporting said cup to said counter table; and said cup outlet being of the open/close type cup and mounted on said counter table for allowing, when it is opened, said cup which was lifted by said vertical cup transport means to extend from said outlet.

16. A cup type automatic vending machine according to claim 15, further comprising:

a vending door for opening and closing said outlet;

a detecting means for detecting the opening and closing conditions of said vending door; and a control means for allowing said cup holding unit to transfer the cup to said vertical cup transport unit when said detecting means detects the vending door open.

17. A cup type automatic vending machine according to claim 15, further comprising:

a cup presence detecting means for detecting the presence of a cup at said cup outlet;

a coin receiving means;

a memory means for permitting selecting drinks and storing information on the selection;

a detection means for detecting if a customer has taken his cup from said cup outlet; and a means for starting vending operation commodity selection during a drink vending operation, including means for memorizing the selected drink and means for offering the selected drink thus memorized to the customer when the cup presence detecting means detects that the cup is not present in the vending corner because a cup filled with drink has been taken out during the drink vending operation.

18. A cup type automatic vending machine according to claim 15, further comprising:

a cup presence detection means for detecting the presence of a cup at said cup outlet;

a means for returning said cup holding unit to its standby status provided that the cup holding unit has transferred the cup to said vertical cup transport unit;

a means for releasing and dropping a cup for the next vending operation;

a means for injecting said selected drink into said cup; and a means for moving said cup holding unit to said vertical cup transport unit under the condition that said cup presence detection means detects no cup in said cup outlet.

19. A cup type automatic vending machine according to claim 15, further comprising:

a cup chute for guiding said cup released from said cup supplying unit;

a cup detection means for detecting if a cup is trapped in said cup chute; and a gas injection means for injecting gas into said cup chute if a trapped cup is detected by said cup detection means.

20. A cup-type automatic vending machine for vending drinks comprising:

means for supplying cups;

means for holding a cup released from said cup supplying means;

means in said machine for injecting drink in a cup held by said cup holding means;

an outlet in a portion of said vending machine;

a vending door for opening and closing said outlet;

drive means for opening said door when a cup filled with drink is to be offered;

cup transport means for transporting said cup from the position of injecting drink to said outlet; and cup disposal means operating with said cup transporting means for allowing disposal of cups prior to a cup reaching said outlet.

21. A cup type automatic vending machine according to claim 20, further comprising:

means for detecting a cup left over in the cup transport means during power failure, after power is recovered;

means for moving a cup detected by said detecting means by operating said cup transport means to said cup disposal means; and means for returning said cup transport means to the position where drink is injected in a cup if said detecting means detects no cup in the cup transport means.

22. A cup type automatic vending machine according to claim 20, further comprising:

means for holding a cup released from said cup supplying means;

means provided above said cup holding means for detecting the presence of a cup; and means for judging if a cup is blocked according to the detecting operation of said cup presence detecting means.

23. A cup type automatic vending machine according to claim 20 further comprising:

means including a pair of opening/closing type cup grabbers for holding a cup released and dropped from said cup supplying means;

means for detecting if the cup is misplaced in said cup holding means; and means for controlling the opening/closing operation of said pair of cup grabbers when a misplaced cup is detected by said misplaced cup detecting means.

* * * * *